US009004942B2

(12) United States Patent
Paniagua

(10) Patent No.: US 9,004,942 B2
(45) Date of Patent: Apr. 14, 2015

(54) ELECTRICAL CONNECTOR WITH HYBRID SHIELD

(71) Applicant: Amphenol Corporation, Wallingford Center, CT (US)

(72) Inventor: Jose Ricardo Paniagua, Newmarket, NH (US)

(73) Assignee: Amphenol Corporation, Wallingford Center, CT (US)

( * ) Notice: Subject to any disclaimer, the term of this patent is extended or adjusted under 35 U.S.C. 154(b) by 0 days.

(21) Appl. No.: 13/654,065

(22) Filed: Oct. 17, 2012

(65) Prior Publication Data

US 2013/0109232 A1 May 2, 2013

Related U.S. Application Data

(60) Provisional application No. 61/548,107, filed on Oct. 17, 2011.

(51) Int. Cl.

| | |
|---|---|
| ***H01R 13/6581*** | (2011.01) |
| ***H01R 43/00*** | (2006.01) |
| ***H01R 13/6461*** | (2011.01) |
| *H01R 12/73* | (2011.01) |

(52) U.S. Cl.

CPC ..... *H01R 13/6581* (2013.01); *H01R 43/00* (2013.01); *H01R 13/6461* (2013.01); *H01R 12/735* (2013.01)

(58) Field of Classification Search

USPC ..... 439/607.01, 607.05, 607.07

See application file for complete search history.

(56) References Cited

U.S. PATENT DOCUMENTS

| | | | |
|---|---|---|---|
| 2,996,710 | A | 8/1961 | Pratt |
| 3,002,162 | A | 9/1961 | Garstang |
| 3,134,950 | A | 5/1964 | Cook |
| 3,322,885 | A | 5/1967 | May et al. |
| 3,786,372 | A | 1/1974 | Epis et al. |

(Continued)

FOREIGN PATENT DOCUMENTS

| | | |
|---|---|---|
| EP | 1 779 472 A1 | 5/2007 |
| EP | 2 169 770 A2 | 3/2010 |

(Continued)

OTHER PUBLICATIONS

International Preliminary Report on Patentability for PCT/US2012/060610 dated Apr. 22, 2014.

(Continued)

*Primary Examiner* — Alexander Gilman

(74) *Attorney, Agent, or Firm* — Wolf, Greenfield & Sacks, P.C.

(57) ABSTRACT

An electrical connector with reduced cross talk and controlled impedance. The connector comprises hybrid shields with lossy portions and conductive portions. The synergistic effect of the lossy portions and the conductive portions allows the hybrid shields to be relatively thin such that they can be incorporated into the mating interface regions or other mechanically constrained regions of the connector to provide adequate crosstalk suppression without undesirably impacting impedance. The conductive portions may be shaped to preferentially position the conductive regions adjacent signal conductors susceptible to cross talk to further contribute to the synergy. The conductive regions may include holes to contribute to desired electrical properties for the connector.

40 Claims, 14 Drawing Sheets

(56) References Cited

U.S. PATENT DOCUMENTS 3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,636,752 A 1/1987 Saito
4,682,129 A 7/1987 Bakermans et al.
4,751,479 A 6/1988 Parr
4,761,147 A 8/1988 Gauthier
4,846,724 A 7/1989 Sasaki et al.
4,878,155 A 10/1989 Conley
4,948,922 A 8/1990 Varadan et al.
4,970,354 A 11/1990 Iwasa et al.
4,992,060 A 2/1991 Meyer
5,000,700 A 3/1991 Masubuchi et al.
5,141,454 A 8/1992 Garrett et al.
5,150,086 A 9/1992 Ito
5,168,252 A 12/1992 Naito
5,168,432 A 12/1992 Murphy et al.
5,266,055 A 11/1993 Naito et al.
5,280,257 A 1/1994 Cravens et al.
5,287,076 A 2/1994 Johnescu et al.
5,340,334 A 8/1994 Nguyen
5,346,410 A 9/1994 Moore, Jr.
5,456,619 A 10/1995 Belopolsky et al.
5,461,392 A 10/1995 Mott et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,299,483 B1 10/2001 Cohen et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,371,117 B2 5/2008 Gailus
7,494,383 B2 2/2009 Cohen et al.
7,540,781 B2 6/2009 Kenny et al.
7,581,990 B2 9/2009 Kirk et al.
7,588,464 B2 9/2009 Kim
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,874,873 B2 1/2011 Do et al.
7,887,371 B2 2/2011 Kenny et al.
7,906,730 B2 3/2011 Atkinson et al.
7,914,304 B2 3/2011 Cartier et al.
8,083,553 B2 12/2011 Manter et al.
8,182,289 B2 5/2012 Stokoe et al.
8,215,968 B2 7/2012 Cartier et al.
8,272,877 B2 9/2012 Stokoe et al.
8,371,875 B2 2/2013 Gailus
8,382,524 B2 2/2013 Khilchenko et al.
8,636,543 B2 * 1/2014 McNamara ..... 439/607.07
8,657,627 B2 2/2014 McNamara et al.
8,771,016 B2 7/2014 Atkinson et al.
2001/0042632 A1 11/2001 Manov et al.
2002/0042223 A1 4/2002 Belopolsky et al.
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2004/0020674 A1 * 2/2004 McFadden et al. ..... 174/35 MS
2004/0115968 A1 6/2004 Cohen
2004/0121652 A1 * 6/2004 Gailus ..... 439/608
2004/0196112 A1 10/2004 Welbon et al.
2004/0259419 A1 12/2004 Payne et al.
2005/0070160 A1 3/2005 Cohen et al.
2005/0133245 A1 6/2005 Katsuyama et al.
2005/0176835 A1 8/2005 Kobayashi et al.
2005/0283974 A1 12/2005 Richard et al.
2005/0287869 A1 12/2005 Kenny et al.
2006/0068640 A1 3/2006 Gailus
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 * 8/2008 Gailus ..... 439/608
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0117386 A1 5/2009 Vacanti et al.
2009/0239395 A1 9/2009 Cohen et al.
2009/0291593 A1 11/2009 Atkinson et al.
2010/0081302 A1 4/2010 Atkinson et al.
2010/0294530 A1 11/2010 Atkinson et al.
2011/0003509 A1 1/2011 Gailus
2011/0230095 A1 * 9/2011 Atkinson et al. ..... 439/607.06
2011/0230096 A1 9/2011 Atkinson et al.
2011/0287663 A1 11/2011 Gailus et al.
2012/0094536 A1 4/2012 Khilchenko et al.

(56) References Cited

U.S. PATENT DOCUMENTS

| | | | |
|---|---|---|---|
| 2012/0156929 | A1 | 6/2012 | Manter et al. |
| 2012/0202363 | A1 | 8/2012 | McNamara et al. |
| 2012/0202386 | A1 | 8/2012 | McNamara et al. |
| 2013/0012038 | A1 | 1/2013 | Kirk et al. |
| 2013/0017733 | A1 | 1/2013 | Kirk et al. |
| 2013/0078870 | A1 | 3/2013 | Milbrand, Jr. |
| 2013/0196553 | A1 | 8/2013 | Gailus |
| 2013/0225006 | A1 | 8/2013 | Khilchenko et al. |
| 2014/0004726 | A1 | 1/2014 | Cartier, Jr. et al. |
| 2014/0004746 | A1 | 1/2014 | Cartier, Jr. et al. |
| 2014/0057498 | A1 | 2/2014 | Cohen |

FOREIGN PATENT DOCUMENTS

| | | | |
|---|---|---|---|
| GB | 1272347 | A | 4/1972 |
| JP | 07302649 | A | 11/1995 |
| WO | WO 88/05218 | A1 | 7/1988 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |

OTHER PUBLICATIONS

International Search Report for PCT/US2012/060610 dated Mar. 29, 2013.

Extended European Search Report for EP 11166820.8 mailed Jan. 24, 2012.

International Search Report with Written Opinion for International Application No. PCT/US06/25562 dated Oct. 31, 2007.

International Search Report and Written Opinion from PCT Application No. PCT/US2005/034605 dated Jan. 26, 2006.

International Search Report and Written Opinion for International Application No. PCT/US2010/056482 issued Mar. 14, 2011.

International Preliminary Report on Patentability for International Application No. PCT/US2010/056482 issued May 24, 2012.

International Search Report and Written Opinionfor PCT/US2011/026139 dated Nov. 22, 2011.

International Preliminary Report on Patentability for PCT/US2011/026139 dated Sep. 7, 2012.

International Search Report and Written Opinion for International Application No. PCT/US2011/034747 dated Jul. 28, 2011.

PCT Search Report and Written Opinion for Application No. PCT/US2012/023689 mailed on Sep. 12, 2012.

International Preliminary Report on Patentability for Application No. PCT/US2012/023689 mailed on Aug. 15, 2013.

International Search Report and Written Opinion for PCT/US2012/060610 dated Mar. 29, 2013.

[No Author Listed] "Carbon Nanotubes for Electromagnetic Interference Shielding," SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.

Beaman, High Performance Mainframe Computer Cables, Electronic Components and Technology Conference, 1997, pp. 911-917.

Shi et al, "Improving Signal Integrity in Circuit Boards by Incorporating Absorbing Materials," 2001 Proceedings. 51st Electronic Components and Technology Conference, Orlando FL. 2001:1451-56.

* cited by examiner

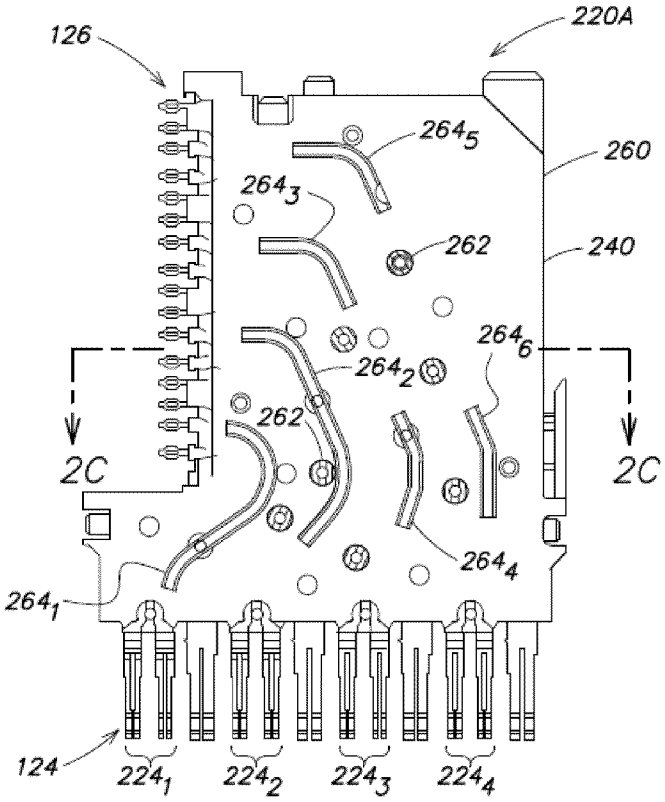
FIG. 13B
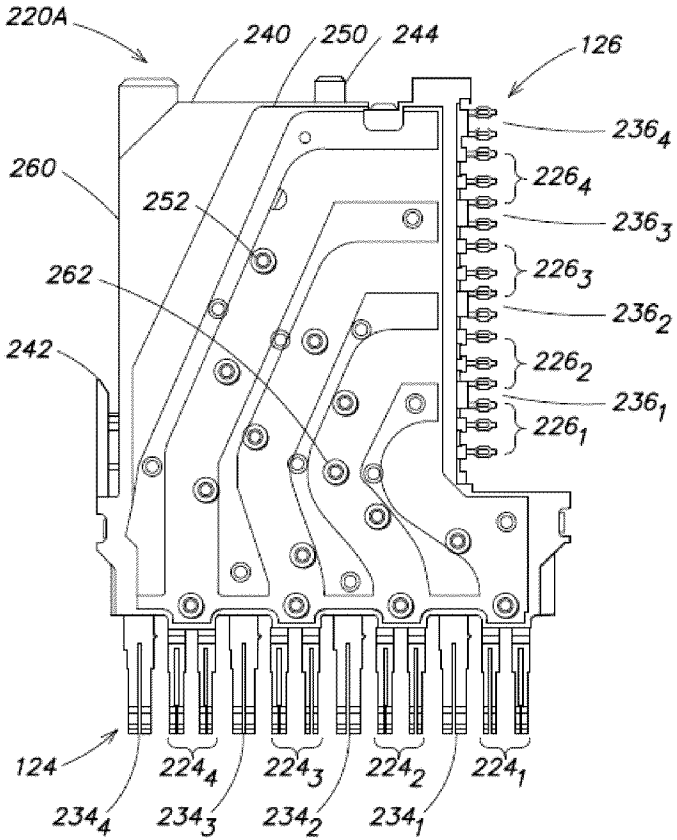
FIG. 13A
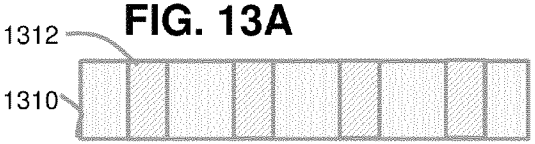

Data collected using handmade prototypes

ELECTRICAL CONNECTOR WITH HYBRID SHIELD

RELATED APPLICATIONS

This application claims priority under 35 U.S.C. §119(e) to U.S. provisional patent application Ser. No. 61/548,107, filed on Oct. 17, 2011, which is hereby incorporated by reference in its entity.

BACKGROUND

This invention relates generally to electrical interconnection systems and more specifically to improved signal integrity in interconnection systems, particularly in high speed electrical connectors.

Electrical connectors are used in many electronic systems. It is generally easier and more cost effective to manufacture a system on several printed circuit boards ("PCBs") that are connected to one another by electrical connectors than to manufacture a system as a single assembly. A traditional arrangement for interconnecting several PCBs is to have one PCB serve as a backplane. Other PCBs, which are called daughter boards or daughter cards, are then connected through the backplane by electrical connectors.

Electronic systems have generally become smaller, faster and functionally more complex. These changes mean that the number of circuits in a given area of an electronic system, along with the frequencies at which the circuits operate, have increased significantly in recent years. Current systems pass more data between printed circuit boards and require electrical connectors that are electrically capable of handling more data at higher speeds than connectors of even a few years ago.

One of the difficulties in making a high density, high speed connector is that electrical conductors in the connector can be so close that there can be electrical interference between adjacent signal conductors. To reduce interference, and to otherwise provide desirable electrical properties, metal members are often placed between or around adjacent signal conductors. The metal acts as a shield to prevent signals carried on one conductor from creating "crosstalk" on another conductor. The metal also impacts the impedance of each conductor, which can further contribute to desirable electrical properties.

As signal frequencies increase, there is a greater possibility of electrical noise being generated in the connector in forms such as reflections, crosstalk and electromagnetic radiation. Crosstalk between different signal paths through a connector can be limited by arranging the various signal paths so that they are spaced further from each other and nearer to a shield, such as a grounded plate. Thus, the different signal paths tend to electromagnetically couple more to the shield and less with each other.

Shields for isolating conductors from one another are typically made from metal components. U.S. Pat. No. 6,709,294 (the '294 patent), which is assigned to the same assignee as the present application and is hereby incorporated by reference in its entirety, describes making an extension of a shield plate in a connector from conductive plastic.

Electrical characteristics of a connector may also be controlled through the use of absorptive material. U.S. Pat. No. 6,786,771, which is assigned to the assignee of the present application and which is hereby incorporated by reference in its entirety, describes the use of absorptive material to reduce unwanted resonances and improve connector performance, particularly at high speeds (for example, signal frequencies of 1 GHz or greater, particularly above 3 GHz).

U.S. Published Application 2006/0068640 and U.S. patent application Ser. No. 12/062,577, both of which are assigned to the assignee of the present invention and are hereby incorporated by reference in their entireties, describe the use of lossy materials to improve connector performance.

SUMMARY

An improved electrical connector that operates at high frequencies with lower crosstalk is provided, through the selective positioning of lossy and conductive materials adjacent to conductive members within the connector.

In some embodiments, the lossy member is combined with regions of conductive material. The combined lossy member and conductive regions may be positioned adjacent to conductive elements acting as signal conductors in an electrical connector. The combined lossy and conductive materials, for example, may be positioned inside a connector housing. The position and amount of lossy and/or conductive material may be selected to provide a desired reduction of crosstalk in a desired frequency range without an undesired change in impedance of the conductive elements.

In some embodiments, the combined lossy and conductive material may be thin enough to be positioned in areas of a connector in which space is limited by mechanical constraints. Nonetheless, the combined lossy and conductive material is thin enough that the mechanical integrity of the connector is not compromised. Moreover, the combined lossy and conductive material need not be connected to a ground, enabling the combined lossy and conductive material to be used in more places within an interconnection system relative to a traditional shield.

The lossy material and conductive material may be positioned relative to each other such that energy associated with electromagnetic fields reaching the conductive material is dissipated in the lossy material. In some embodiments, the conductive material may be joined to the lossy material. The joining method may be heat bonding or the application of a conductive adhesive, although any suitable method for providing an electrically conductive join may be used. Though, in other embodiments, the conductive material may be held adjacent to the lossy material through mechanical means, such as by inserting a lossy member and a conductive member into a common slot or through the use of some other structure that presses the conductive material and lossy material together.

In some embodiments, the lossy material has a bulk conductivity between 10 siemens/meter and 100 siemens/meter, with a range of 40-60 siemens/meter. The conductive material may be a metal, such as copper or gold, or may be any suitable conductive non-metal. The conductive material may be a metal foil or in some other form, such as a conductive ink. The conductive material may have a thickness between 1 and 5 mils. The lossy material may have any suitable thickness, such as from 5 mils to 100 mils. The conductive region may be connected to an electrical ground or may be floating. A floating or grounded configuration may be chosen based on mechanical or other considerations.

In some embodiments, the conductive and lossy regions may be planar. Though, the materials may conform to any suitable shape for integration into an interconnection system, and in some embodiments may have a non-planar shape, such as a serpentine shape to position the lossy material close to or in contact with conductive elements acting as ground conductors.

In further embodiments, the surface area of the conductive material may be less than the surface area of the lossy material. Such a configuration may increase the frequencies at which electromagnetic energy, reaching the conductive regions, resonates in regions between adjacent conductive regions within an electrical connector. Though reducing the amount of conductive material may reduce the amount of shielding provided, the conductive material may be disposed in a pattern that positions the conductive material such that, in combination with the lossy material, an effective shield is provided.

In yet other embodiments, the conductive region may be sized to align with the electromagnetic field present close to conductive elements designated as signal conductors within the electrical connector. As one example, the surface area of the conductive region may be greater in a location directly facing the conductive elements designated as signal conductors, where, in operation, the electromagnetic field might be expected to be stronger relative to nearby locations, and may be smaller directly facing conductive elements designated as ground conductors, where the electromagnetic field might be expected to be weaker relative to nearby locations. The shape of the conducting regions may also be selected based on a projected electromagnetic field profile at the location of the conducting region, though may be any suitable shape that provides the desired shielding effect.

In further embodiments, the conductive and lossy regions are sized and positioned in order to suppress electrical crosstalk, without introducing resonances in the shielding, over a range of frequencies, for example in the range 1 GHz to 20 GHz. As a specific example, using techniques as described herein, a connector may be made with cross talk of less than −50 dB over a desired operating frequency range. Crosstalk, for example, may be measured as far end cross talk. The desired operating frequency range may span any suitable frequency range, such as, for example, up to 25 GHz. Though, in some embodiments, the frequency range may have other upper limits, such as up to 20 GHz or 15 GHz. Such cross talk may be achieved with a connector of any suitable dimensions, including a connector in which conductive elements separated by a hybrid shield with lossy and conductive regions have center-to-center spacing of 2 mm or less. In some embodiments, for example, the spacing may be 1.85 mm or 1.7 mm. Though, it should be appreciated that any suitable spacing may be used.

The foregoing is a non-limiting summary of the invention. It is understood that the features of the embodiments described herein may be practiced alone, or in combination.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 13A is a plan view of a first type wafer adjacent to a first type hybrid shield member, illustrating alignment of conductive regions of the hybrid shield members with signal conductors in an alternative style of wafer that may be used together in a connector;

FIG. 13B is a plan view of a second type wafer adjacent to a second type hybrid shield, that may be used together, in an alternating pattern with a wafer as in FIG. 13A, in a connector;

DETAILED DESCRIPTION

The inventor has recognized and appreciated that an improved high speed, high density interconnection system may be achieved using a hybrid shield. A hybrid shield may incorporate lossy portions and conductive portions. Without being bound by any particular theory of operation, the inventor believes that the selective incorporation of metal into the hybrid shield improves the effectiveness of the lossy material at dissipating electromagnetic energy that might otherwise contribute to cross talk, even if the metal portions are floating. As a result, the hybrid shield may be made relatively thin such that it can be incorporated into an electrical connector, or other portion of the interconnection system, in which cross talk can arise. Yet, the amount of conductive material present may be small enough that it does not cause resonances or significantly alter the impedance of conductive elements acting as signal conductors at frequencies in the desired range of operating frequencies.

Figure 1:
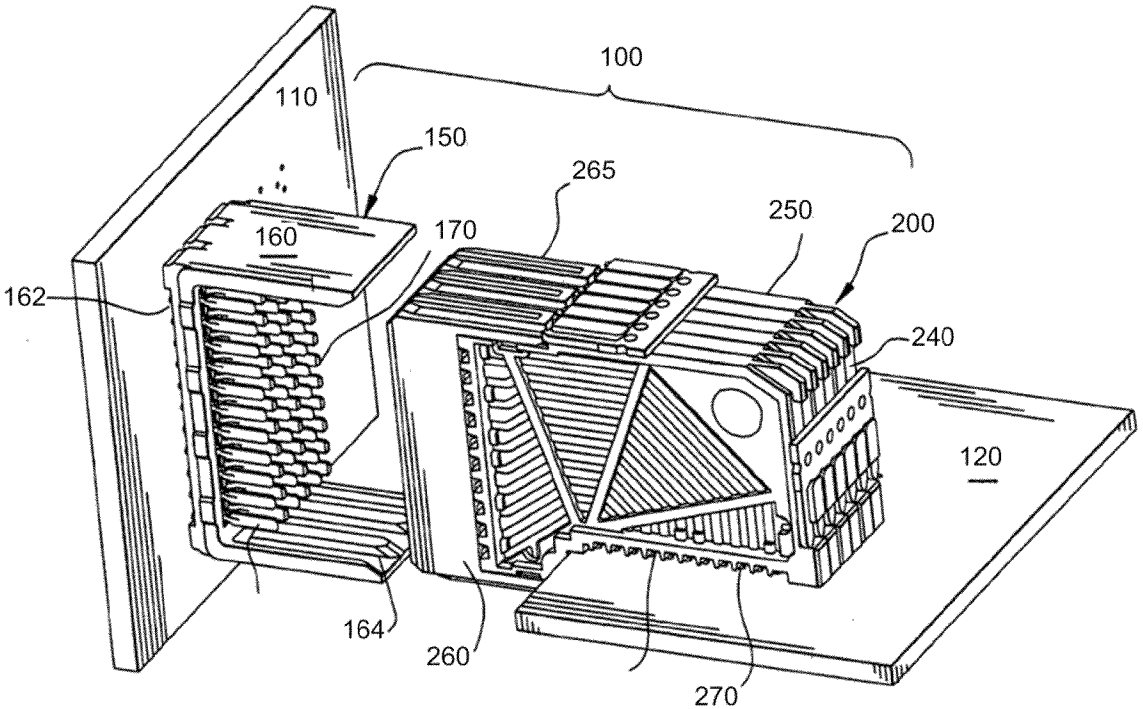
FIG. 1 is a perspective view of a conventional electrical interconnection system comprising a backplane connector and a daughter card connector.

Referring to FIG. 1, a conventional electrical interconnection system 100 is shown. Interconnection system 100 is an example of an interconnection system that may be improved through the selective placement of conductive materials and electrically lossy materials, as described below. In the example of FIG. 1, interconnection system 100 joins PCBs 110 and 120. The electrical interconnection system 100 comprises a backplane connector 150 and a daughter card connector 200, providing a right angle connection.

Daughter card connector 200 is designed to mate with backplane connector 150, creating electrically conducting paths between backplane 110 and daughter card 120. Though not expressly shown, interconnection system 100 may interconnect multiple daughter cards having similar daughter card connectors that mate to similar backplane connectors on backplane 110. Accordingly, the number and type of printed circuit boards or other substrates connected through an interconnection system is not a limitation on the invention.

FIG. 1 shows an interconnection system using a right angle backplane connector. It should be appreciated that in other embodiments, the electrical interconnection system 100 may include other types and combinations of connectors, as the invention may be broadly applied in many types of electrical connectors, such as right angle connectors, mezzanine connectors, card edge connectors and chip sockets.

Backplane connector 150 and daughter card connector 200 each contains conductive elements. The conductive elements of daughter card connector 200 are coupled to traces, ground planes or other conductive elements within daughter card 120. The traces carry electrical signals and the ground planes provide reference levels for components on daughter card 120. Ground planes may have voltages that are at earth ground or positive or negative with respect to earth ground, as any suitable voltage level may act as a reference level.

Similarly, conductive elements in backplane connector 150 are coupled to traces, ground planes or other conductive elements within backplane 110. When daughter card connector 200 and backplane connector 150 mate, conductive elements in the two connectors mate to complete electrically conductive paths between the conductive elements within backplane 110 and those within daughter card 120.

Backplane connector 150 includes a backplane shroud 160 and a plurality of conductive elements. The conductive elements of backplane connector 150 extend through floor 162 of the backplane shroud 160 with portions both above and below floor 162. Here, the portions of the conductive elements that extend above floor 162 form mating contacts, such as mating contact 170. These mating contacts are adapted to mate with corresponding mating contacts of daughter card connector 200. In the illustrated embodiment, mating contacts 170 are in the form of blades, although other suitable contact configurations may be employed, as the present invention is not limited in this regard.

Tail portions (obscured by backplane 110) of the conductive elements extend below the shroud floor 162 and are adapted to be attached to backplane 110. These tail portions may be in the form of a press fit, "eye of the needle" compliant sections that fit within via holes on backplane 110. However, other configurations are also suitable, such as surface mount elements, spring contacts, solderable pins, etc., as the invention is not limited in this regard.

In the embodiment illustrated, backplane shroud 160 is molded from a dielectric material such as plastic or nylon. Examples of suitable materials are liquid crystal polymer (LCP), polyphenyline sulfide (PPS), high temperature nylon or polypropylene (PPO). Other suitable materials may be employed, as the present invention is not limited in this regard. All of these are suitable for use as binder materials in manufacturing connectors according to some embodiments of the invention. One or more fillers may be included in some or all of the binder material used to form backplane shroud 160 to control the mechanical properties of backplane shroud 160. For example, thermoplastic PPS filled to 30% by volume with glass fiber may be used to form shroud 160. In accordance with some embodiments of the invention, fillers to control the electrical properties of regions of the backplane connector may also be used.

In the embodiment illustrated, backplane connector 150 is manufactured by molding backplane shroud 160 with openings to receive conductive elements. The conductive elements may be shaped with barbs or other retention features that hold the conductive elements in place when inserted in the openings of backplane shroud 160.

The backplane shroud 160 further includes grooves, such as groove 164, that run vertically along an inner surface of the side walls of the backplane shroud 160. These grooves serve to guide front housing 260 of daughter card connector 200 engage projections 265 and into the appropriate position in shroud 160.

In the embodiment illustrated, daughter card connector 200 includes a plurality of wafers, for example, wafer 240. Each wafer comprises a column of conductive elements, which may be used either as signal conductors or as ground conductors. FIG. 1 illustrates an open pin field connector in which all conductive elements are shaped to carry signals, though in use some may be connected to ground. Though, it should be appreciated that the invention is not limited to use with an open pin field connector and may be used, for example, in a connector in which some conductive elements are designated to act as signal conductors and others are designated to act as ground conductors by providing different shapes for the signal and ground conductors.

In the embodiment illustrated, connector 100 includes six wafers each with twelve conductive elements. However these numbers are for illustration only. The number of wafers in daughter card connector and the number of conductive elements in each wafer may be varied as desired.

Wafer 240 may be formed by molding wafer housing 250 around conductive elements that form signal and ground conductors. As with shroud 160 of backplane connector 150, wafer housing 250 may be formed of any suitable material or materials, some of which, in some embodiments, may be lossy.

In the illustrated embodiment, daughter card connector 200 is a right angle connector and has conductive elements that traverse a right angle. Each conductive element may comprise a mating contact (shown as 280 in FIG. 2A) on one end to form an electrical connection with a mating contact 170 of the backplane connector 150. On the other end, each conductive element may have a contact tail 270 (see also FIG. 2A) that can be electrically connected with conductive elements within daughter card 120. In the embodiment illustrated, contact tail 270 is a press fit "eye of the needle" contact that makes an electrical connection through a via hole in daughter card 140. However, any suitable attachment mechanism may be used instead of or in addition to via holes and press fit contact tails. Each conductive element also has an intermediate portion between the mating contact and the contact tail, and the intermediate portion may be enclosed by or embedded within the wafer housing 250.

The mating contacts of the daughter card connector may be housed in a front housing 260 (FIG. 1). Front housing 260 may protect mating contacts 280 from mechanical forces that could damage the mating contacts. Front housing 260 may also serve other purposes, such as providing a mechanism to guide the mating contacts 280 of daughter card connector 200 into engagement with mating contact portions of backplane connector 150.

Front housing 260 may have exterior projections, such as projection 265 (FIG. 1). These projections fit into grooves 164 on the interior of shroud 160 to guide the daughter card connector 200 into an appropriate position. The wafers of daughter card connector 200 may be inserted into front housing 260 such that mating contacts are inserted into and held within cavities in front housing 260 (see also FIG. 4). The cavities in front housing 260 are positioned so as to allow mating contacts of the backplane connector 150 to enter the cavities in front housing 260 and to form electrical connection with mating contacts of the daughter card connector 120.

The plurality of wafers in daughter card connector 200 may be grouped into pairs in a configuration suitable for use as a differential electrical connector. In this example, the pairs are broadside coupled, with conductive elements in the adjacent wafers aligning broadside to broadside. For instance, in the embodiment shown in FIG. 1, daughter card connector 200 comprises six wafers that may be grouped into three pairs. Though, the number of wafers held in a front housing is not a limitation on the invention. Instead of or in addition to front housing 260 holding six wafers, each pair of wafers may have their own front housing portion (see e.g. FIG. 2B).

However, the wafers need not be coupled into a broadside coupling configuration, and may be coupled, for example, via the coupling of adjacent pairs of conductive elements in a single wafer. Though, the exact coupling method is not a limitation on the invention and any suitable coupling method could be used. In some embodiments, hybrid shields may be incorporated into a connector such that each hybrid shield separates adjacent pairs of signal conductors, regardless of whether those pairs are formed of broadside or edge coupled signal conductors.

Figure 2B:
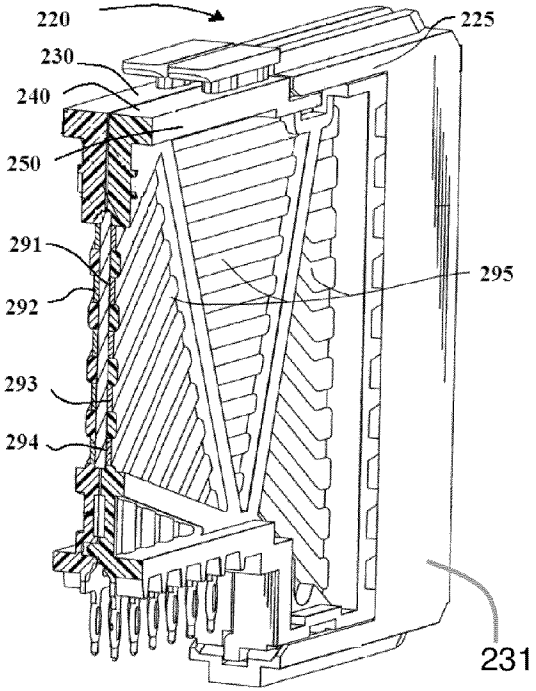
FIG. 2B is a perspective view, partially cut away, of a subassembly of the daughter card connector of FIG. 1.
Figure 2A:
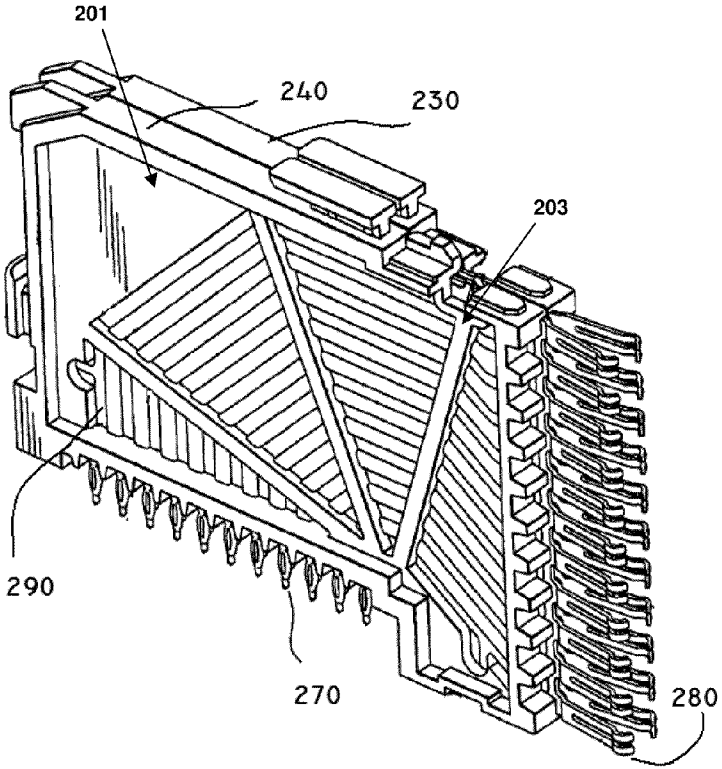
FIG. 2A is a perspective view of two wafers forming a subassembly of the daughter card connector of FIG. 1.

FIG. 2A shows a pair of wafers 230 and 240 coupled together. Any suitable mechanism may be used to mechanically couple the wafers. For example, affixing the wafers in a front housing portion could provide adequate mechanical coupling. However, spacers, snap-fit features or other structures may be used to hold the wafers together and control the spacing between the conductive elements in the wafers.

As illustrated, the conductive elements in these wafers are arranged in such a way that, when these wafers are mechanically coupled together, conductive elements in wafer 230 are electrically broadside coupled with corresponding conductive elements in wafer 240. For instance, conductive element 290 of wafer 240 is broadside coupled with the conductive element in wafer 230 that is located in a corresponding position. Each such pair of conductive elements may be used as ground conductors or differential signal conductors, as the example illustrates an open pin field connector.

Broadside coupling of conductive elements is further illustrated in FIG. 2B, which shows a subassembly with an alternative construction technique for forming a front housing. In the embodiment of FIG. 2B a front housing is created by separate front housing portions attached to pairs of wafers. These components form a subassembly 220, including a front housing portion 225 and two wafers 230 and 240. To form a connector, subassemblies 220 may be positioned side by side to form a connector of a desired length.

In the embodiment of FIG. 2B, front housing portion 225 acts as a front housing for two wafers. To form a connector with six columns as shown in FIG. 1, three subassemblies as pictured in FIG. 2B may be positioned side-by-side and secured with a stiffener or using any other suitable approach. In such an embodiment, a hybrid shield may be positioned between adjacent front housing portions, such as along region 231.

Front housing portion 225 may be molded of any suitable material, such as a material of the type used to make front housing 260. Front housing portion 225 may have exterior dimensions and may have cavities as in front housing 260 to allow electrical and mechanical connections to backplane connector 150, as described above.

In FIG. 2B, portions of wafers 230 and 240 are shown partially cutaway to expose a column of conductive members in each wafer. Wafer 230 comprises conductive elements, of which conductive element 292 is numbered. In wafer 240 conductive elements 291, 293 and 294 are numbered. Conductive elements 291 and 292 are broadside coupled, forming a pair suitable for carrying differential signals. Though not numbered, other conductive elements that align in the parallel columns also form broadside coupled pairs.

In the scenario illustrated in FIG. 2B, the space between two pairs of coupled conductive elements is devoid of filler elements. At high frequencies, for example above 1 GHz, electrical signals in one pair of coupled conductive elements can create crosstalk interference in an adjacent second pair of coupled conductive elements. In the embodiments illustrated, the spacing between rows of coupled conductive elements is driven by mechanical considerations. For example, crosstalk can be reduced by placing rows of coupled conductive elements further apart, but would increase the size of the connector, reducing its suitability for industrial applications.

The inventor has recognized and appreciated that a problem arises through electrical coupling of nearby pairs of conductive elements as illustrated in FIGS. 1, 2A and 2B. This problem can be particularly disruptive at high signal frequencies, for example above 1 GHz.

Figure 3:
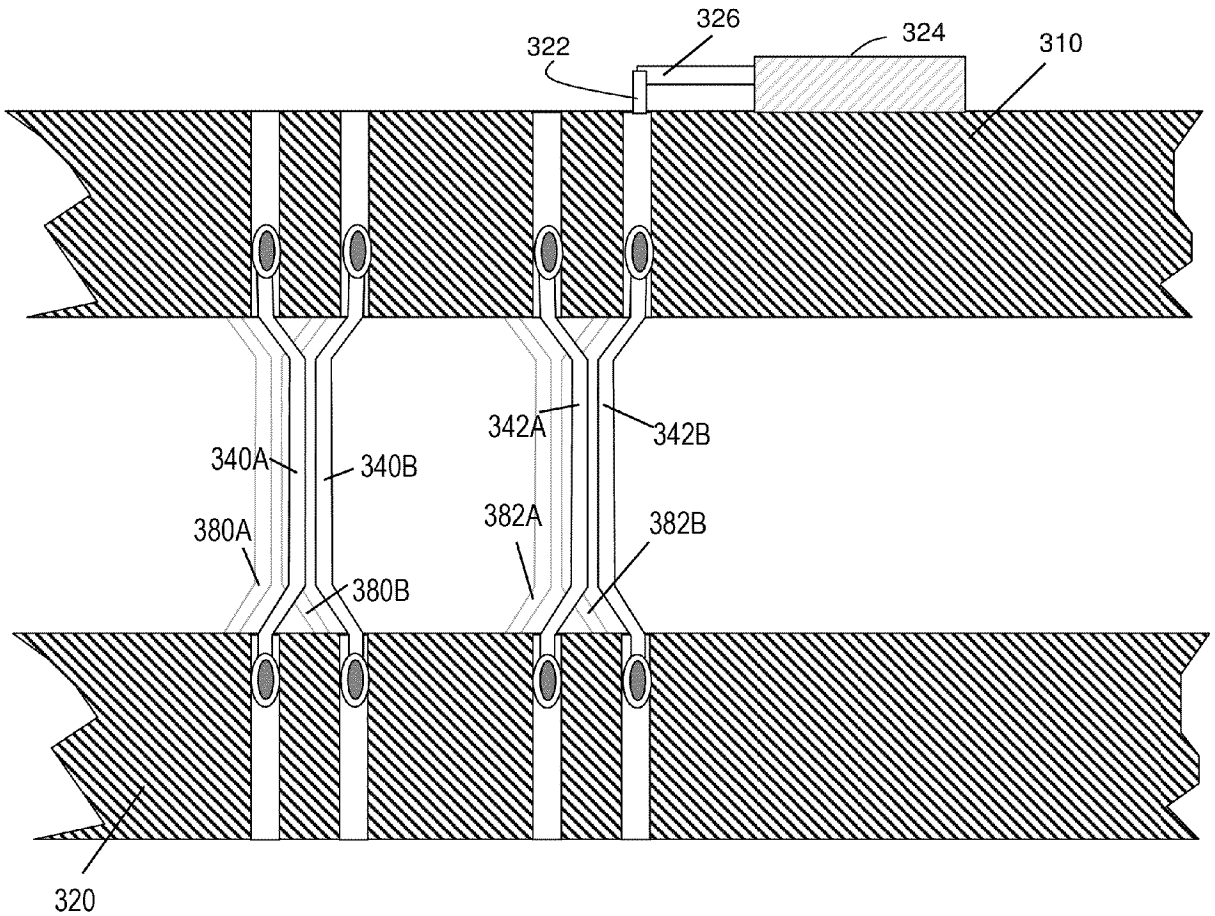
FIG. 3 is a schematic representation of a portion of an electrical interconnection system showing conductor pairs mated with two PCBs.

FIG. 3 is a schematic representation of a conducting path formed in an interconnection system using an electrical connector as illustrated in FIG. 1, 2A or 2B. Conducting paths 340A and 340B represent a pair of conducting paths formed through mated connectors joining a first printed circuit board 310 to a second printed circuit board 320. In the embodiment illustrated, conducting paths 342A and 342B form a separate pair. Such conducting paths, for example, could be formed through an interconnection system such as interconnection system 100.

Each of the conducting paths may include a conductive element within a daughter card connector, which may be mounted to printed circuit board 320, and a conductive element within a backplane connector, which may be mounted to printed circuit board 310. For simplicity, connector housings and mating interfaces between conductive elements are not shown in the schematic representation of FIG. 3. Also, the arrangement of conducting paths as illustrated in FIG. 3 may be created in any suitable way, including through the use of separable connections.

In FIG. 3, sets of electrical conducting paths 380A-B and 382A-B are shown located within a plane parallel to that occupied by electrical conducting paths 340A-B and 342A-B. This arrangement is provided as an example, and there is no limitation that other sets of electrical conducting paths be located in a parallel plane, nor is there a limitation that groups of electrical conducting paths be located within the same plane.

Conducting paths 380A and 380B represent a pair of conducting paths formed through mated connectors joining a printed circuit board 310 to printed circuit board 320. These conducting paths may form a differential pair, supporting propagation of a differential signal. In the embodiment illustrated, conducting paths 382A and 382B form a separate pair. The four pairs of conducting paths in the embodiment illustrated, 340A-B, 342A-B, 380A-B, 382A-B, may be coupled to printed circuit boards 310 and 320 via a conductive element within a daughter card connector. However, the arrangement of conducting paths as illustrated in FIG. 3 may be created in any suitable way.

FIG. 3 illustrates that the conductive paths between the printed circuit boards 310 and 320 are arranged to provide conductive paths which may propagate different signals, and where the spacing between the conductive paths is relatively small. For example, conductive paths 340A and 340B may be propagating a signal different than the signal being propagated through conductive paths 380A and 380B. As discussed above, this may lead to electrical interference or crosstalk in conductive paths 380A and 380B as a result of its proximity to conductive paths 340A and 340B, and vice versa. The magnitude of electrical interference may vary with the frequency of the electrical signal being propagated through conductive paths 340A and 340B or conductive paths 380A and 380B.

The inventor has recognized and appreciated that a connector as illustrated in FIGS. 1, 2A and 2B may result in electrical interference in pairs of conducting paths as a result of their proximity to other pairs of conducting paths. For example, an electronic component, such as component 324, coupled to signal trace 326 through a via 322 may output such a signal that excites resonances. Signals that may be passing through the connector have the potential to excite resonances within pairs of conducting paths, leading to crosstalk.

The inventor has recognized and appreciated that selective placement within the connector of conductive material combined with lossy material may improve the overall performance of the connector.

Multiple approaches are possible for the placement of lossy material and conductive material. In some embodiments, a lossy member with conductive regions is positioned adjacent to electrically conducting paths. The conductive regions capture electromagnetic energy that could create crosstalk in nearby electrical conductors, and the lossy material, coupled to the conductive regions, allows the captured electromagnetic energy to dissipate, thereby reducing crosstalk.

For conductive pairs used to carry signals, the lossy material may cause a loss of signal energy. However, the inventors have recognized and appreciated that, through the selective placement of conductive and lossy materials, the effect of reducing crosstalk outweighs the effect of reducing signal energy.

Any suitable lossy material may be used. Materials that conduct, but with some loss, over the frequency range of interest are referred to herein generally as "lossy" materials. Electrically lossy materials can be formed from lossy dielectric and/or lossy conductive materials. The frequency range of interest depends on the operating parameters of the system in which such a connector is used, but will generally have an upper limit between about 1 GHz and 25 GHz, though higher frequencies or lower frequencies may be of interest in some applications. Some connector designs may have frequency ranges of interest that span only a portion of this range, such as 1 to 10 GHz or 3 to 15 GHz or 3 to 6 GHz.

Electrically lossy material can be formed from material traditionally regarded as dielectric materials, such as those that have an electric loss tangent greater than approximately 0.003 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain particles or regions that are sufficiently dispersed that they do not provide high conductivity or otherwise are prepared with properties that lead to a relatively weak bulk conductivity over the frequency range of interest. Electrically lossy materials typically have a conductivity of about 1 siemens/meter to about $6.1\times10^7$ siemens/meter, preferably about 1 siemens/meter to about $1\times10^7$ siemens/meter and most preferably about 1 siemens/meter to about 30,000 siemens/meter. In some embodiments material with a bulk conductivity of between about 10 siemens/meter and about 100 siemens/meter may be used. As a specific example, material with a conductivity of about 50 siemens/meter may be used. Though, it should be appreciated that the conductivity of the material may be selected empirically or through electrical simulation using known simulation tools to determine a suitable conductivity that provides both a suitably low cross talk with a suitably low insertion loss.

Electrically lossy materials may be partially conductive materials, such as those that have a surface resistivity between 1 Ω/square and $10^6$ Ω/square. In some embodiments, the electrically lossy material has a surface resistivity between 1 Ω/square and $10^3$ Ω/square. In some embodiments, the electrically lossy material has a surface resistivity between 10 Ω/square and 100 Ω/square. As a specific example, the material may have a surface resistivity of between about 20 Ω/square and 40 Ω/square.

In some embodiments, electrically lossy material is formed by adding to a binder a filler that contains conductive particles. Examples of conductive particles that may be used as a filler to form an electrically lossy material include carbon or graphite formed as fibers, flakes or other particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure or can otherwise be used to position the filler material. In some embodiments, the binder may be a thermoplastic material such as is traditionally used in the manufacture of electrical connectors to facilitate the molding of the electrically lossy material into the desired shapes and locations as part of the manufacture of the electrical connector. Examples of such materials include LCP and nylon. However, many alternative forms of binder materials may be used. Curable materials, such as epoxies, can serve as a binder. Alternatively, materials such as thermosetting resins or adhesives may be used. Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic housing. As used herein, the term "binder"

encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Ticona. A lossy material, such as lossy conductive carbon filled adhesive preform, such as those sold by Techfilm of Billerica, Mass., US may also be used. This preform can include an epoxy binder filled with carbon particles. The binder surrounds carbon particles, which acts as a reinforcement for the preform. Such a preform may be inserted in a wafer to form all or part of the housing. In some embodiments, the preform may adhere through the adhesive in the preform, which may be cured in a heat treating process. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

Regardless of the specific lossy material used, one approach to reducing the coupling between adjacent conducting pairs is to position lossy and conducting material between rows of conducting pairs, for example as an insert into a daughter card connector. Such an approach may reduce the amount of energy coupled to adjacent conducting pairs and therefore reduce the magnitude of any crosstalk induced.

Figure 4:
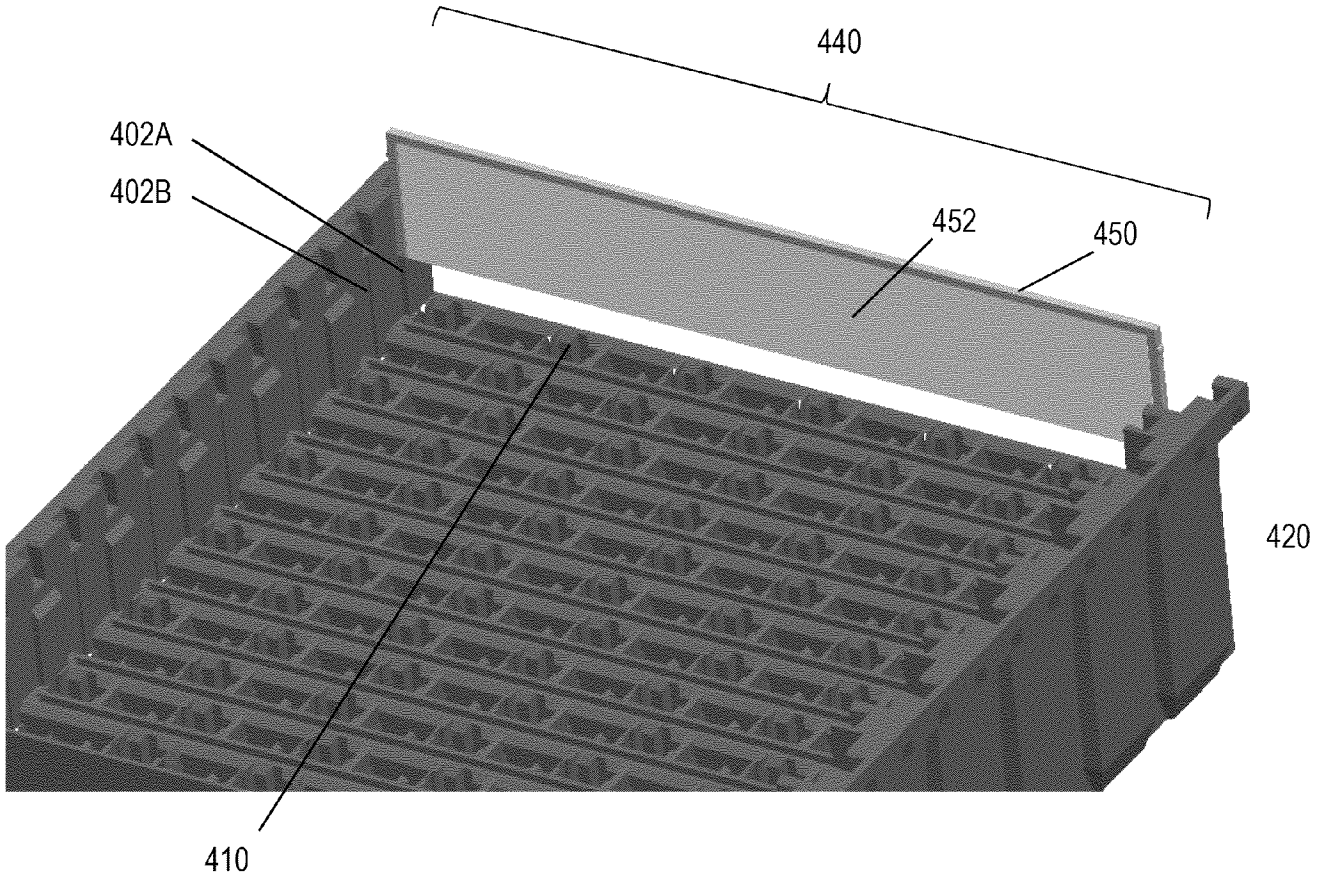
FIG. 4 is a perspective view of a portion of a connector housing adapted to receive subassemblies and a hybrid shield.

FIG. 4 illustrates one embodiment for positioning a lossy member combined with conducting material for the purposes of reducing crosstalk. FIG. 4 shows a front housing portion 420 of a daughter card connector. Multiple wafers may be inserted into front housing portion 420. Each of the wafers may have a lead frame over-molded with a plastic, leaving mating contact portions exposed. The plastic portions of the wafers may be attached to front housing portion 420, to support the wafer with the mating contact portions inside cavities, such as cavity 410, within the front housing portion 420.

In the illustrated embodiment, housing portion 420 contains slots 402A, 402B used to hold a plurality of hybrid shield members A single hybrid shield member 440 is shown in the figure. Slots other than 402A and 402B are illustrated but not labeled for clarity. Hybrid shield member 440 is composed of a lossy member 450 combined with a conducting region 452. Housing portion 420 contains cavities, shown in the figure but with a single cavity labeled as example cavity 410. Cavity 410 is configured to receive mating contacts of conductive elements when one or more wafers of a daughter card connector are fitted onto the front housing portion.

As illustrated, the cavities, such as cavity 410, are arranged in columns, each column receiving conductive elements from a wafer. When the wafers are attached to connector housing portion 420, a hybrid shield member 440 occupies the slots between mating contacts of adjacent pairs. In this example the pairs are in adjacent columns.

Figure 5:
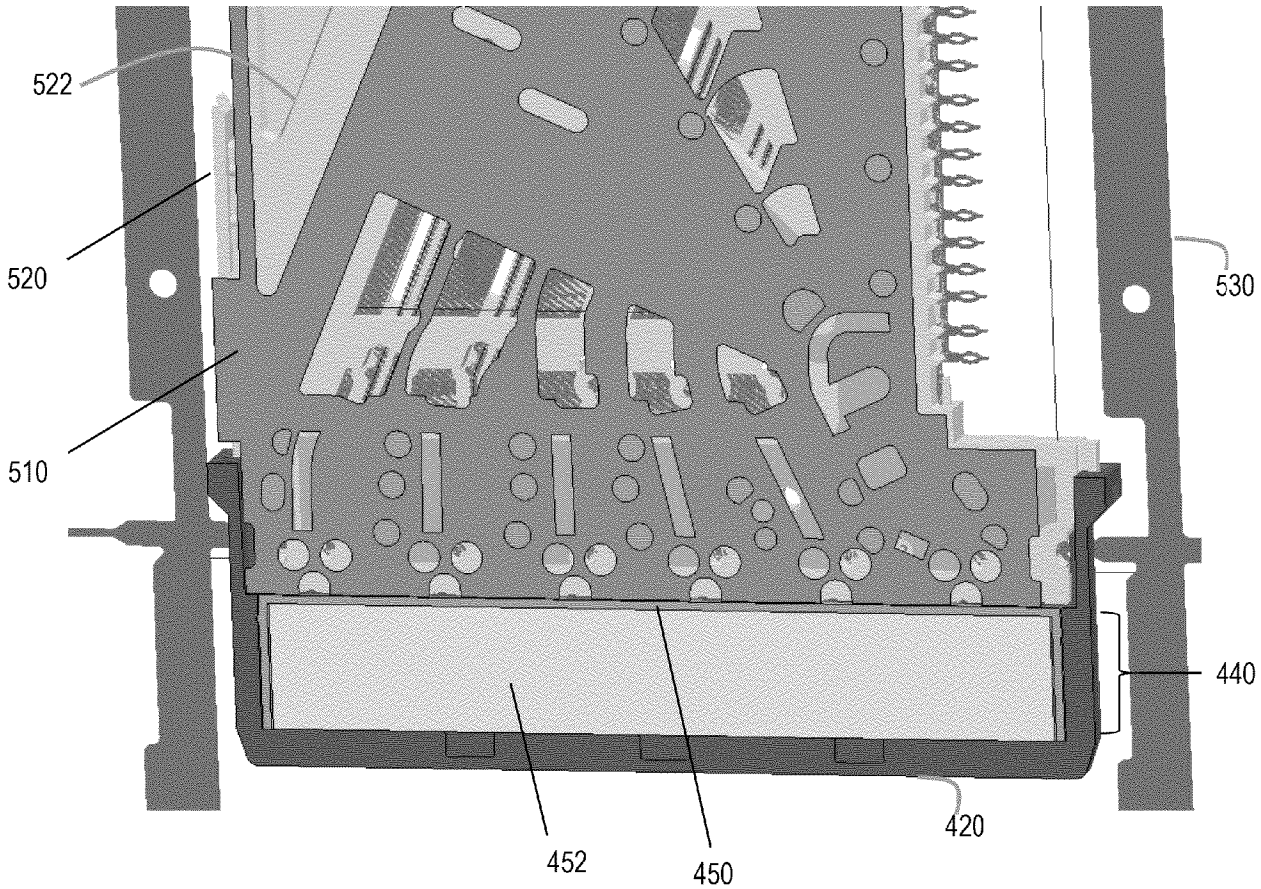
FIG. 5 is a perspective view of a wafer connected to the portion of the connector housing of FIG. 4, which is shown partially cutaway to reveal the hybrid shield.

Housing portion 420 may form a portion of any suitable type of connector, for example the daughter card connector shown in FIG. 2A and FIG. 2B. FIG. 5 shows a wafer 520 of a daughter card connector inserted into connector housing portion 420. In this embodiment, wafer 520 contains a lead frame 530 containing multiple conductive elements, each of which includes a mating contact portion (not shown) inserted into a cavity (such as those shown in FIG. 4) of the housing portion 420.

In this example, the lead frame 530 is shown with carrier strips. Such carrier strips may be used during manufacture of the wafers or the connector. For example, the lead frame 530 may be manufactured by stamping a sheet of metal to leave the conductive elements held together by the carrier strips. An insulative portion 522 may be molded over the conductive elements, using a known insert molding technique. In some embodiments, lossy material 510 may be added to wafer 520. In some embodiments, the lossy material may be over molded on the insulative portion 522. Though, the lossy material 510 may be adhered to the insulative portion 522 using adhesive or may be held in place through the use of mechanical attachment features or in any other suitable way.

As can be seen, the lossy material 510 may reduce unwanted electromagnetic radiation along intermediate portions of the conductive elements of wafer 520. However, in the embodiment illustrated, the mating contact portions of the conductive elements are shaped as beams such that they have compliant portions that move during mating of a daughter card connector to a mating contact. To allow the mating portions to move they are not embedded in the lossy material 510. However, cross talk is reduced in the vicinity of the mating contact portions through the inclusion of a hybrid shield. The thin profile of the hybrid shield allows it to be incorporated into the front housing portion, even when there is little space between mating contact portions.

Figure 6A:
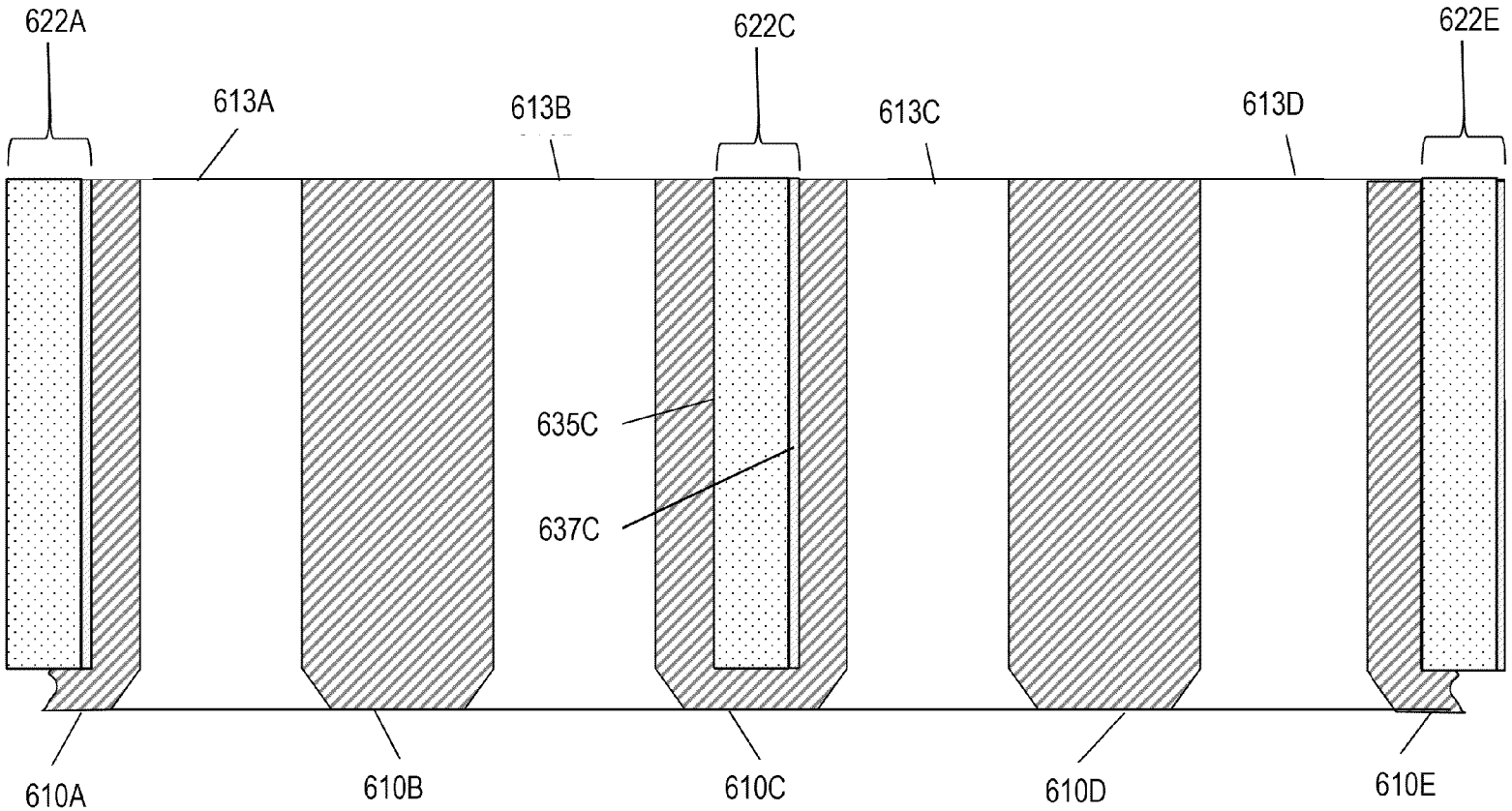
FIG. 6A is a schematic cross-sectional view of a front housing of a daughter card connector according to some embodiments of the invention, showing a plurality of cavities for receiving mating contact portions of mating daughter card and backplane connectors with a plurality of hybrid shield members disposed between adjacent pairs.

FIG. 6A is a cross-sectional view of a front housing of a daughter card connector according to some embodiments of the invention, showing a plurality of internal walls 610A-E separating cavities 613A-D. Cavities 613A-D are configured to receive mating contacts of conductive elements when the front housing is fitted onto one or more wafers of the daughter card connector. Portions of internal walls 610A-E that may come into contact with mating contacts may be formed or lined with insulative material. In the illustrated embodiment, some of the internal walls, i.e., 610A, 610C, and 610E, each comprise a slot to receive a hybrid shield member composed of a lossy member combined with conductive regions. Hybrid shield members 622A, 622C, and 622E are inserted into slots in internal walls 610A, 610C, and 610E. As an example, hybrid shield member 622C is composed of lossy member 635C and conductive region 637C.

The hybrid shield members may be formed in any suitable way. In some embodiments, the lossy material may be a plastic with conductive fillers that is molded into a member of a desired shape. In some embodiments, the lossy member may act as a structural member for the hybrid shield. One or more conductive portions may then be adhered to the member. The conductive portions may be adhered using conductive adhesive or other suitable attachment mechanism.

Though, in some embodiments, the hybrid shield may be formed using an insert molding operation, such that the conductive portions are embedded in the lossy portions. Accordingly, in some embodiments, the conductive portions may be either partially exposed or fully surrounded by the lossy material.

In some embodiments, the conductive portions may be formed of metal, such as a metal foil. Though, it is not a requirement that the conductive portion be metal foil. In some embodiments, the conductive portions may be formed of conductive ink that is "painted" onto the lossy material. Alternatively or additionally, metal may be deposited onto the lossy portion, using known techniques for coating plastics. In yet other embodiments in which the conductive portions are also formed from a binder containing conducting fillers the hybrid shield may be formed by a two shot molding operation. The conductive portions may be formed in one of the shots using a material with more fillers or more conductive fillers than the lossy portions.

These and other construction techniques may be used to form a structure with a suitable arrangement of lossy and conductive materials. The lossy material, for example may have a bulk conductivity between about 10 Siemens per meter and 100 Siemens per meter. The conductive portions may have a bulk conductivity in excess of 100 Siemens per meter. The bulk conductivity, for example, may be in excess of 1000 Siemens per meter.

Further, it should be appreciated that it is not a requirement that the lossy and conductive portions be formed integrally with one another. Any construction technique that holds the lossy portion close enough to the conductive portion to dissipate electrical energy in the conductive portion may be used. For example the conductive and lossy portions may be formed as separate members that are inserted into slots such that the lossy and conductive portions are pressed together in the slots. Though, any suitable manufacturing techniques may be used.

Cavities 613A and 613B are configured to receive mating contacts of a pair of conductive elements. In the embodiment illustrated, all conductive elements will be similarly shaped and any pair may be used as ground conductors or as differential signal conductors. In the embodiments of FIG. 6A, no hybrid shield members are disposed within internal wall 610B, which separates cavities 613A and 613B. These cavities may each receive a mating contact portion of the two conductive elements that form one pair. Likewise, cavities 613C and 613D are configured to receive mating contacts of another pair of conductive elements, and no hybrid shield members are disposed within internal wall 610D.

In some alternative embodiments, internal walls 610B and 610D may be diminished in size or omitted entirely. Such a configuration may reduce the effective dielectric constant of material between conductive elements that form a differential pair and increase coupling.

Figure 6B:
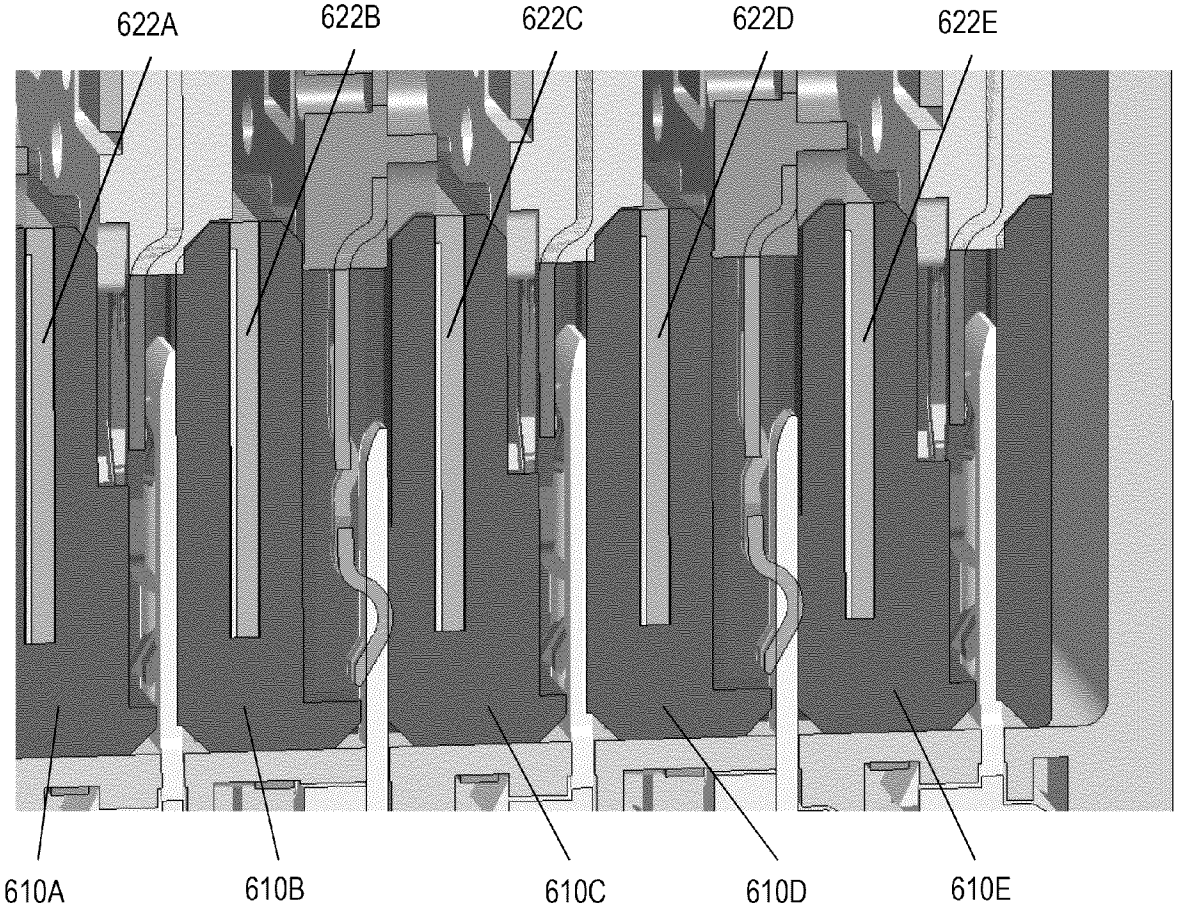
FIG. 6B is a perspective view of a front housing of a daughter card connector according to some embodiments of the invention, showing a plurality of hybrid shield members disposed between adjacent pairs of mated daughter card and backplane connectors.

FIG. 6B is a schematic cross-section of a front housing of a daughter card connector according to some embodiments of the invention, showing a plurality of internal walls 610A-E containing hybrid shield members 622A-E. In the configuration illustrated, the hybrid shields are positioned between columns of signal conductors to separate adjacent signal conductors.

Figure 7:
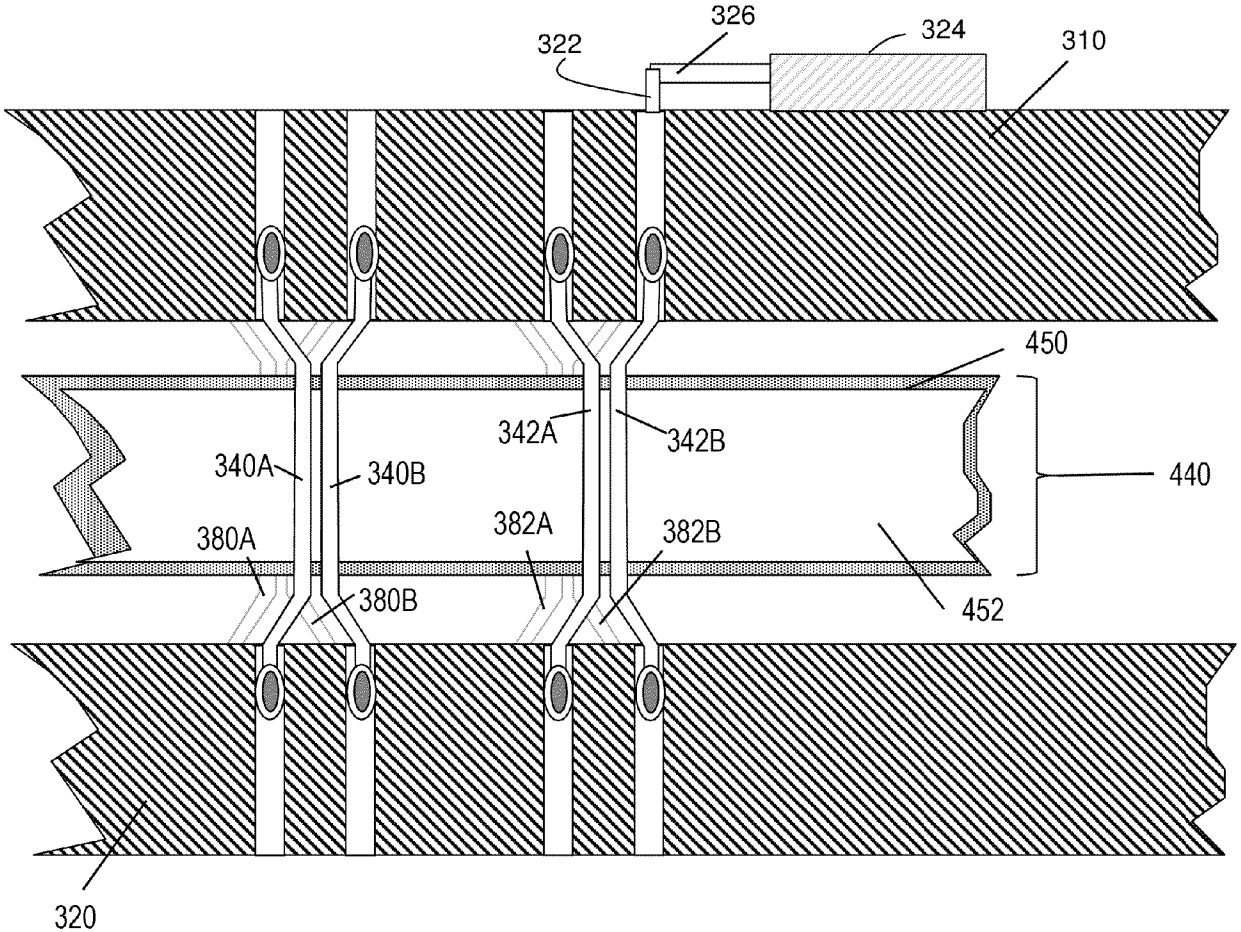
FIG. 7 is a schematic representation of a portion of an electrical interconnection system showing pairs of conducting elements connecting two PCBs, similar to FIG. 3, with the addition of a hybrid shield.

In some embodiments of the invention, an internal wall and the associated hybrid shield members may run along an entire column of pairs of conductive elements. FIG. 7 schematically illustrates such an arrangement, with insulative walls omitted to show more clearly the relative positioning of a hybrid shield member with respect to the conductive elements.

FIG. 7 shows a hybrid shield member 440, composed of lossy member 450 and conductive region 452, located between two rows of conductive pairs located on either side of hybrid shield member 440. Two printed circuit boards 310 and 320 connected to the conductive pairs are shown for illustration. Conductive paths 340A-B and 342A-B are located on one side of the hybrid shield member and conductive paths 380A-B and 382A-B are located on the other side of the hybrid shield member.

In this embodiment, the hybrid shield member is planar, although any suitable shape that provides the desired shielding to reduce crosstalk may be used. The thickness of the conducting region in one embodiment may be within the range 1-5 mils, and, as a specific example, a thickness of around 2 mils may be used. Such a thickness may correspond to a thickness of a commercially available metal film, which may be used to form the conductive portions of a hybrid shield.

Figure 8:
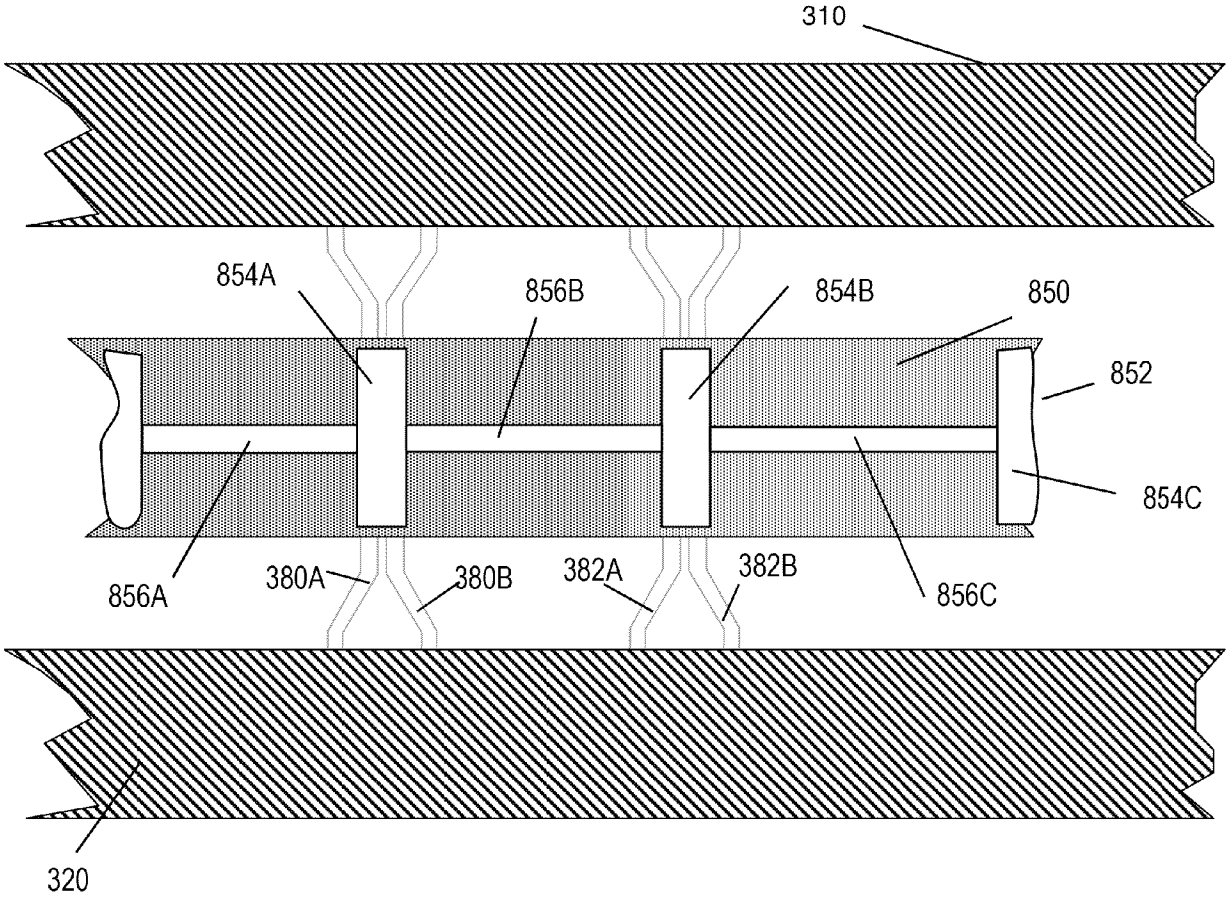
FIG. 8 is a schematic representation of a portion of an electrical interconnection system showing conductor pairs mated with two PCBs, showing an alternative embodiment of the hybrid shield in a "picket fence" configuration.

FIG. 8 shows an alternative embodiment of the hybrid shield. For reference, conducting paths 380A-B and 382A-B are shown. Crosstalk between electrical conductors is due in part to a resonance effect, and the frequency at which the resonance occurs increases as the size of the conductor decreases. In addition, the decrease in impedance attributable to the presence of the shield can also be lessened by using less metal in the hybrid shield. For connectors in which the mating interface is already at a lower impedance than other portions of the conductive paths through the interconnection system, reducing the effect of shielding may be desirable in providing a more uniform impedance along signal paths through the interconnection system. However, a smaller electrical conductor used to shield against crosstalk will provide less shielding, and therefore less attenuation of the crosstalk interference, than a larger electrical conductor used as a shield. This means that a smaller conducting region within the hybrid shield will increase the frequency at which a crosstalk signal occurs in adjacent electrical connectors, but will also reduce the effectiveness of the shield to reduce the crosstalk signal.

One approach to obtain a desired frequency response is to size the conducting region based on an existing frequency response such that the shield can be used to attenuate crosstalk in targeted areas of the frequency spectrum. Since electronic interference is expected to be greater at locations of greater electromagnetic field strength, one approach to sizing the conducting region of the hybrid shield is to selectively position the conducting regions in locations where the electromagnetic field strength is above some cutoff value and decrease the size of the conducting region in locations where the electromagnetic field is below the cutoff value. This exact approach is provided as an example, however, and any scheme to determine the size and shape of the conducting region based upon the electromagnetic field may be used.

In the embodiment of FIG. 8, the conducting region of the hybrid shield is shaped in response to the magnitude of the electromagnetic field. In the regions close to connector paths 380A-B and 382A-B, where the electromagnetic field is greater than a cutoff value, the conducting region has an increased surface area, represented by conducting regions 854A-C. Correspondingly, in the regions between connector paths 380A-B and 382A-B, where the electromagnetic field is smaller than the cutoff value, the conducting region has an decreased surface area, represented by conducting regions 856A-C.

In the embodiment of FIG. 8, conducting regions 854A-C are shaped as a "picket fence." The individual "pickets" are joined by conducting regions 856A-C, which aid mechanical fabrication of the conducting member 852 as illustrated, although conducting regions 856A-C may be omitted leaving only conducting regions 854A-C if this is desired based on the intended shielding to reduce crosstalk, and/or mechanically feasible. Alternatively, other structures could be used to hold the "pickets" together. For example, rather than using a band, such as is formed by conducting regions 856A-C, across the center of the "pickets," bands may be provided at top and bottom, forming a frame around the "pickets." There is no limitation that the conducting region be a single contiguous region, and may be a collection of separate regions, for example strips or dots, although any shape may be used.

Figure 9:
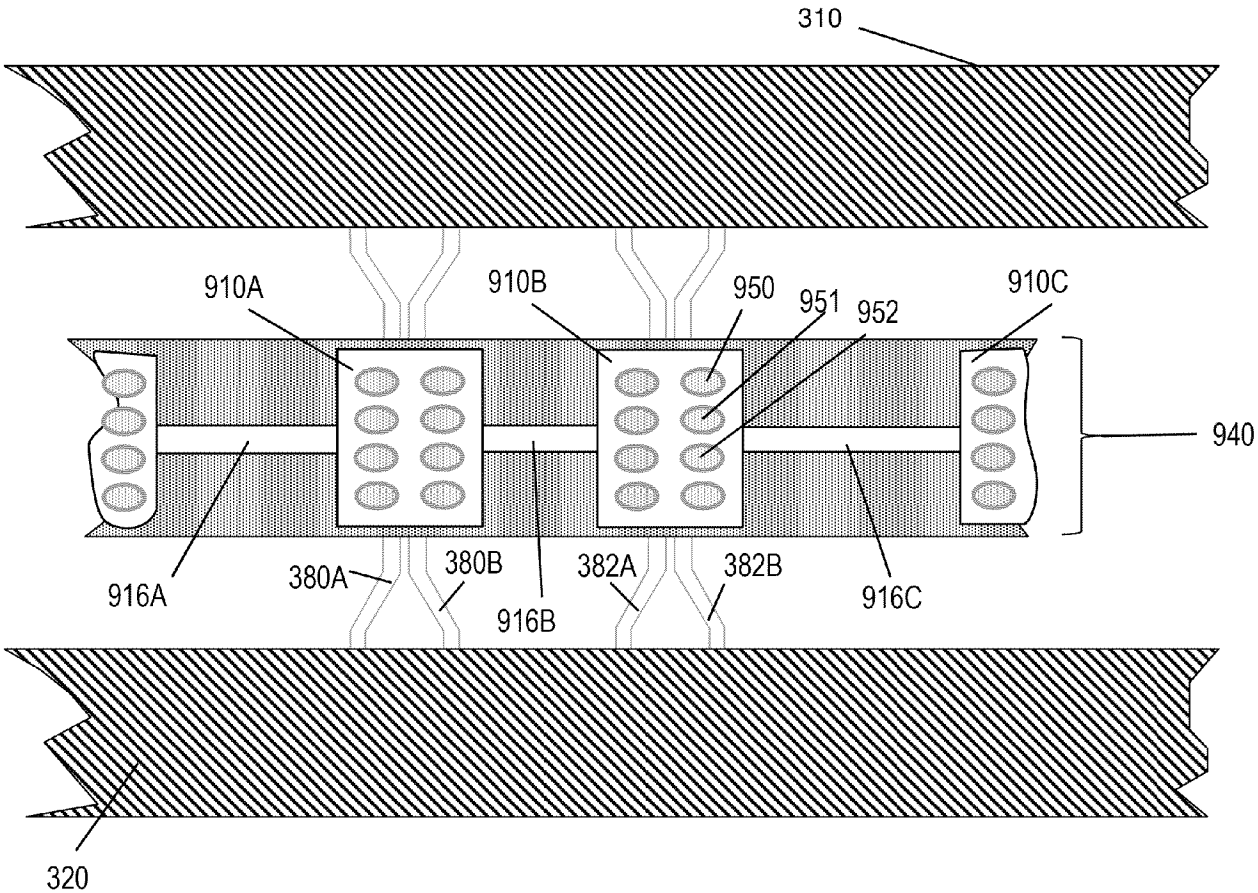
FIG. 9 is a schematic representation of a portion of an electrical interconnection system showing conductor pairs mated with two PCBs, showing an alternative embodiment of the hybrid shield in a "picket fence" configuration and containing holes in the conductive region.

FIG. 9, for example, provides an example of an alternative design for a hybrid shield. In this example, as in the example of FIG. 8, the conductive portions 910A-C and 916A-C of the hybrid shield 940 have a "picket fence" shape. In this example, the "pickets" 910A-C are wider than in the embodiment of FIG. 8. However, the surface area of the conductive portions is approximately the same because of holes, such as hole 950, in the conductive portions. In this example, the holes may have a dimension that is less than on half of a wavelength of the highest frequency in the intended operating range of the connector. Though, the holes may have any suitable size.

This invention is not limited in its application to the details of construction and the arrangement of components set forth in the above description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," or "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art.

As one example, though use of hybrid shields is illustrated in connection with the shielding in the mating interface, hybrid shields may be used in other portions of a connector. For example, the lossy material 510 (FIG. 5) may be replaced by or used in conjunction with a hybrid shield.

Figure 11:
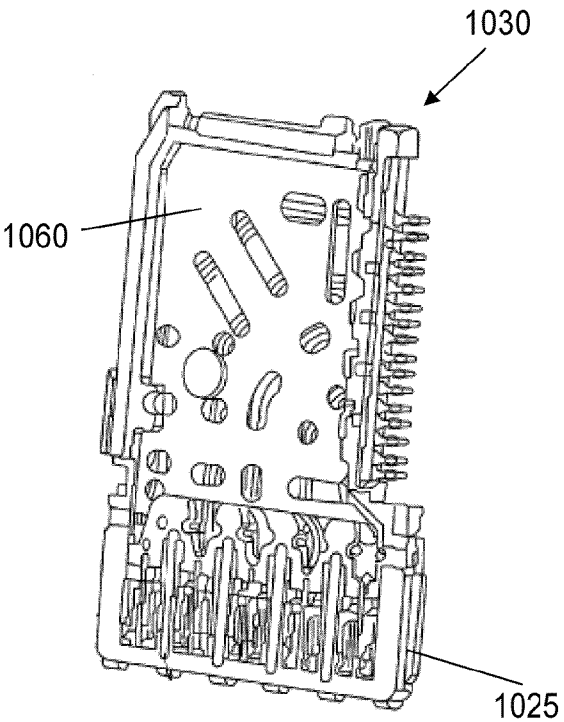
FIG. 11 is a perspective view of a wafer showing hybrid shield members attached to the wafer.
Figure 10:
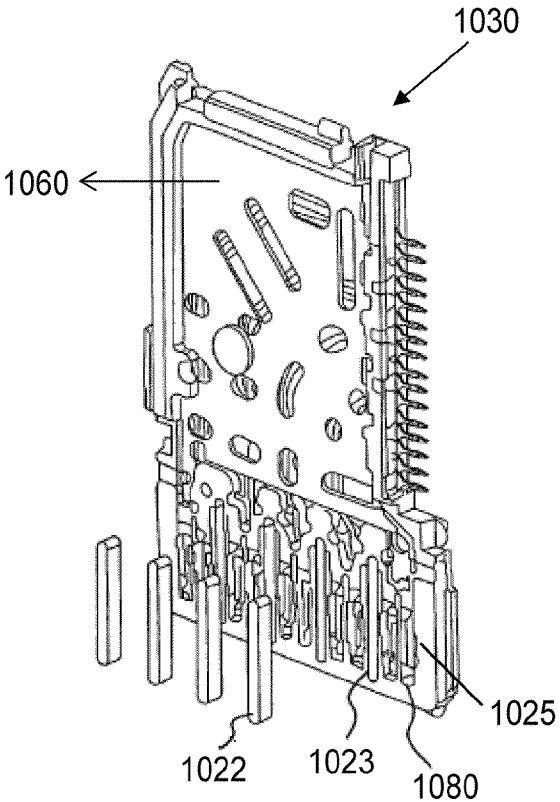
FIG. 10 is a perspective view of a wafer showing an exploded view of a set of hybrid shield members inserted into the wafer.

FIGS. 10 and 11 illustrate an alternative approach for incorporating a hybrid shield into a connector. In this example, members 1022 may be formed as a combination of conductive and lossy material. The members 1022 may then be inserted into slots in a connector housing in regions where unwanted electromagnetic energy may couple between adjacent conductive members. Such an approach may be used for differential signal conductors, in which members 1022 may be positioned between pairs of signal conductors. Though, the same technique may also be used for single ended signal conductors, with members 1022 placed between adjacent conductive elements configured as signal conductors.

Figure 12:
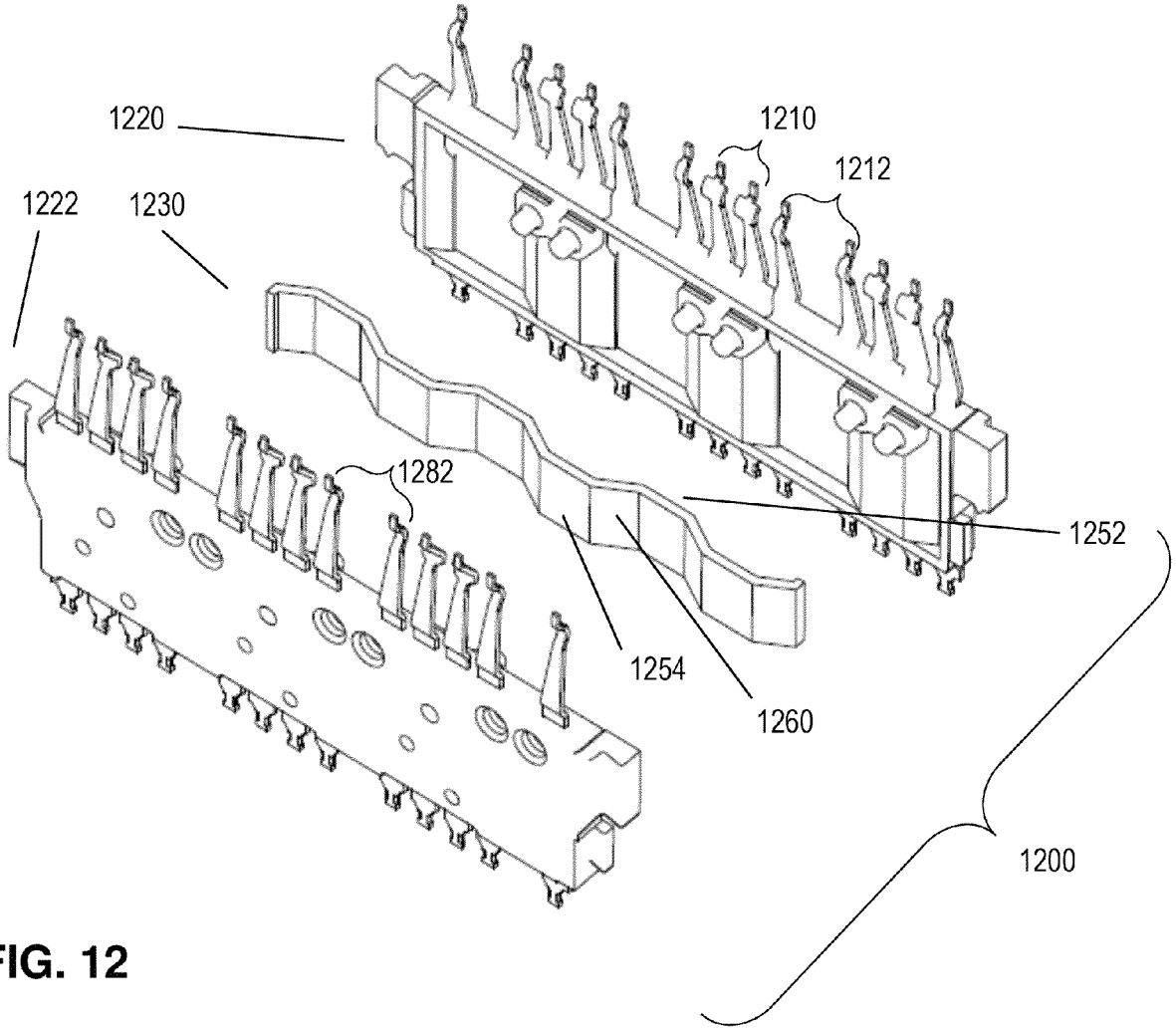
FIG. 12 is a exploded perspective view of two wafers forming a portion of a mezzanine connector in which an insert configured as a hybrid shield member is captured between the wafers.

FIG. 12 illustrates yet a further approach to incorporating a hybrid shield. In this example, the conductive pairs, such as conductive pairs 1210 and 1212, are formed through edge to edge coupling along columns of wafers 1220 and 1222 that are then mechanically attached. An insert 1230 is shown captured between the wafers. Insert 1230 may be formulated as a hybrid shield, and may be incorporated into each wafer in a connector. FIG. 12, in addition to illustrating an alternative technique for incorporating a hybrid shield into a connector, illustrates another connector configuration in which such a shield may be used. In this example, the wafers 1220 and 1222 are for insertion into a mezzanine connector. Each wafer also has a structure with wider conductive elements, configured to act as ground conductors, positioned between pairs of conductive elements, such as conductive elements 1212. Conductive portions may be omitted adjacent the conductive elements acting as grounds, but may be positioned in regions falling along a path between adjacent conductive elements configured to act as signal conductors.

In some embodiments, a connector may be manufactured with certain conductive elements designated to carry signals and others to be connected to ground. When it is known a priori which conductors are to carry signals and which are to be connected to ground, the shape and position of the conductors can be tailored to their function. For example, signal conductors designated to be a pair to carry a differential signal may be routed close to each other. Conductors designated to be connected to ground may be made wider than those carrying high speed signals and may be positioned to shield high speed signals.

FIG. 12 illustrates that hybrid shields may be used in connectors of other types. In this example, wafers that are held together in a subassembly are illustrated. The subassemblies may then be inserted in a housing along with other similar subassemblies to form a mezzanine type connector. In this example, the connectors have contact tails formed as solder balls, thought the nature of the contact tails is not critical to the invention.

FIG. 12 further illustrates a technique in which insert 1230 is a hybrid shield configured in a serpentine pattern, such that the distance between regions of insert 1230 directly facing conductive elements configured to act as ground conductors is less than the distance between regions of insert 1230 directly facing conductive elements configured to act as signal conductors. In this example, insert region 1252 is configured to have reduced distance to conductive elements configured to act as ground conductors 1212 on wafer 1220, whereas insert region 1254 is configured to have increased distance to conductive elements configured to act as signal conductors 1210 on wafer 1220.

Wafers 1220 and 1222, when fitted together, may align conductive elements configured to act as signal conductors on one wafer across from conductive elements configured to act as ground conductors on the other wafer. In this example, insert region 1254 has an increased distance from conductive elements configured to act as signal conductors 1210 on wafer 1220, and will consequently have a decreased distance from conductive elements configured to act as ground conductors 1282 on wafer 1222.

Further, in some embodiments, regions of the insert not situated parallel to the length of the insert, such as insert region 1260, may be the portions of the insert 1230, when formulated as a hybrid shield, which contain conductive regions. In this example, regions parallel to the length of the insert, such as insert regions 1252 and 1254 may contain only lossy material, or may contain conductive material to provide for the mechanical fabrication of such an insert formulated as a hybrid shield. However, these embodiments are provided as examples, and any configuration of lossy and conductive material on a serpentine-shaped insert formulated as a hybrid shield may be used. In addition, the serpentine-shaped insert need not be configured as a series of connected planar regions, and may be any suitable shape in which regions are closer to one neighboring wafer and further from another neighboring wafer.

FIGS. 13A and 13B illustrate a wafer with conductive elements designated as grounds, which are visible as the wider conductive elements. In addition, FIGS. 13A and 13B illustrate different styles of wafer that may be used together in a connector. Each wafer has a different configuration of conductive elements such that, when the two types of wafers are placed side by side in a connector, a ground conductor of one type of wafer may be adjacent a pair of signal conductors of an adjacent wafer of a different type. FIGS. 13A and 13B illustrate a pattern of conductive portions (of which conductive portions 1312 is numbered) on hybrid shields that may be adjacent each type of wafer. In this example, the conductive portions are formed on lossy members (of which lossy member 1310 is numbered). Accordingly, in the embodiment illustrated, two different types of hybrid shields, to match the two types of wafers in use, may be integrated into a connector.

As yet a further example of possible variations, in the embodiments described above, a lossy member combined with conductive material is incorporated into a daughter card connector. A lossy member combined with conductive material may be similarly incorporated into any suitable type of connector, including a backplane connector. For example, a lossy member combined with conductive material may be placed in the floor 162 of shroud 160.

Also, it was described that a lossy member combined with conductive material was incorporated in mating contact regions of a connector because those regions contain electrical connector paths in close proximity to one another, which can lead to crosstalk. Similar effects may exist near the contact tails of a connector. Thus in some embodiments, a lossy member combined with conductive material alternatively or additionally may be selectively positioned adjacent the contact tails of a connector. Moreover, the conditions that give rise to the selection of the mating contact regions in embodiments described above may exist in other locations within an interconnection system. For example, similar conditions may exist within a backplane connector or elsewhere within an interconnection system.

Further, multiple characteristics are described that led to selection of the mating contact regions for selective placement of a lossy member combined with conductive material. Regions for a lossy member combined with conductive material may be selected even if all such characteristics do not exist in the selected locations.

Embodiments are described above in which a lossy member combined with conductive material is positioned between the tightly coupled portions of adjacent pairs or between loosely coupled portions of the pairs. These, and other approaches, may be combined in a single connector.

Such alterations, modifications, and improvements are intended to be part of this disclosure, and are intended to be within the spirit and scope of the invention. Accordingly, the foregoing description and drawings are by way of example only.

As an example of the application of some embodiments described above, FIG. 14A illustrates the signal power insertion loss 1410 in a test set-up including an electrical connector of a type that is commercially available. The insertion loss is shown as a function of signal frequency, and expressed in decibels (dB). In addition, FIG. 14A illustrates crosstalk signal magnitudes 1420 across pairs of signal conductors within the handmade prototype connector as a function of frequency, and expressed in decibels.

Figures 14A, 14B:
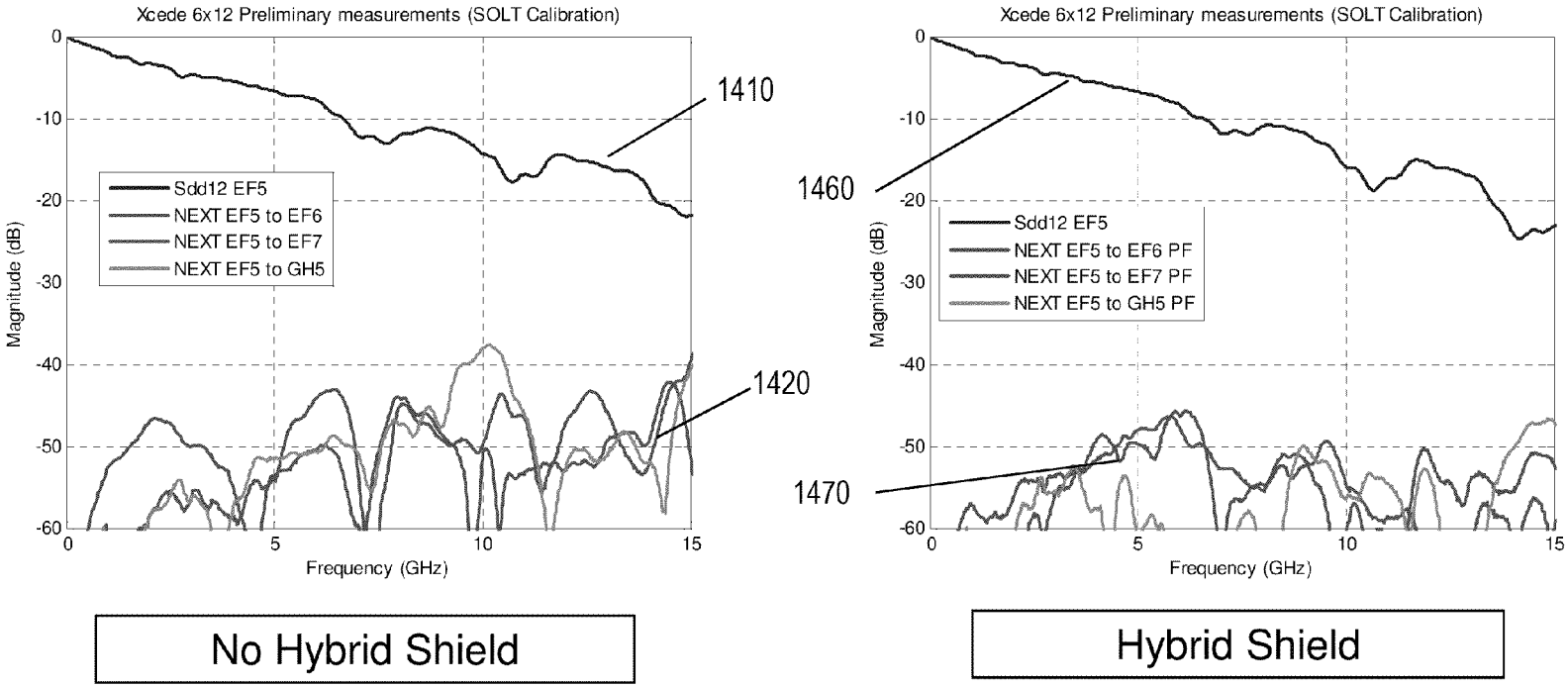
FIG. 14A is a plot showing the crosstalk and insertion loss magnitude across pairs of signal conductors within a high density interconnection system.
FIG. 14B is a plot showing the crosstalk and insertion loss magnitude across pairs of signal conductors within a high density interconnection system, where the interconnection system incorporates a prototype hybrid shield member.

FIG. 14B illustrates the signal power insertion loss 1460 and crosstalk signal magnitudes 1470 across pairs of signal conductors, within a handmade prototype connector containing a handmade prototype hybrid shield. The prototype connector was modified to include the hybrid shield. As can be seen from a comparison of FIGS. 14A and 14B, incorporating a hybrid shield, even in a handmade prototype, has reduced the magnitude of crosstalk, and increased the frequency at which that crosstalk occurs (reducing the likelihood that cross talk with interfere with a signal in a frequency range of interest). However, the magnitude of the insertion loss is not significantly increased by incorporating the lossy material.

The results of including a hybrid shield, as illustrated in FIG. 14A-B provides an example of the effect that a hybrid shield may achieve when incorporated into an electrical connector via one or more of the embodiments described above. While FIGS. 14A and 14B represent real data, the data was obtained using handmade prototypes and should not be considered as a limiting representation of the effects of incorporating a hybrid shield into an electrical connector. The inventor projects that, with tuning and controlled manufacturing techniques, crosstalk can be reduced below −50 dB over the frequency ranges of interest, for example between 1 GHz and 15 GHz.

I claim:

1. An electrical connector, comprising:

an insulative portion;

a plurality of conductive elements supported by the insulative portion, wherein the plurality of conductive elements are positioned in a plurality of columns; and a plurality of hybrid shields, wherein the plurality of hybrid shields:

comprise lossy portions and conductive portions; and are positioned such that each of the plurality of hybrid shields is between adjacent columns of the plurality of conductive elements, wherein at least one hybrid shield of the plurality of hybrid shields is elongated in a first direction, and the conductive portions of the at least one hybrid shield comprise a plurality of conductive regions that are elongated in a second direction, the second direction being orthogonal to the first direction.

2. The electrical connector of claim 1, wherein:

the conductive elements comprise compliant mating portions; and the hybrid shields are adjacent the compliant mating portions.

3. The electrical connector of claim 2, wherein:

the insulative portion comprises a plurality of cavities and a slot adjacent the plurality of cavities;

the compliant mating portions are disposed within the cavities; and a hybrid shield of the plurality of hybrid shields is disposed within the slot.

4. The electrical connector of claim 3, wherein:

the hybrid shield comprises a lossy member and a sheet of metal foil.

5. The electrical connector of claim 4, wherein the metal foil sheet is adhered to the lossy member.

6. The electrical connector of claim 1, wherein:

each of the plurality of hybrid shield comprises a surface adjacent a portion of the plurality of conductive elements; and the surface comprises lossy regions and the conductive regions.

7. The electrical connector of claim 1, wherein:

the lossy regions of the hybrid shields comprise electrically lossy regions.

8. The electrical connector of claim 7, wherein:

the plurality of conductive elements comprise signal conductors and ground conductors;

the conductive regions are disposed adjacent the signal conductors; and the lossy regions are disposed adjacent the ground conductors.

9. The electrical connector of claim 7, wherein:

for each hybrid shield of the plurality of hybrid shields, the conductive regions comprise portions of a conductive member, and the conductive member comprises holes therethrough.

10. The electrical connector of claim 1, wherein:

for each hybrid shield of the plurality of hybrid shields, the hybrid shield comprises a lossy member and a sheet of metal foil.

11. The electrical connector of claim 1, wherein:
for each hybrid shield of the plurality of hybrid shields, the hybrid shield comprises a lossy member and a metal layer, the metal layer having a thickness between 1 mil and 5 mil.

12. The electrical connector of claim 1, wherein:
for each hybrid shield of the plurality of hybrid shields, the hybrid shield comprises a lossy member and a conductive coating on the lossy member.

13. The electrical connector of claim 12, wherein the conductive coating comprises conductive ink.

14. The electrical connector of claim 1, wherein the plurality of hybrid shields are positioned to provide far end cross talk of less than −45 dB with an insertion loss above −30 dB over a frequency range up to 15 GHz.

15. The electrical connector of claim 1, wherein the plurality of hybrid shields are floating.

16. An electrical connector, comprising:
a housing;
a plurality of conductive elements supported by the housing;
a component within the housing, the component comprising:
lossy material; and
conductive material adjacent the lossy material, the conductive material having a thickness less than 5 mils, wherein:
the conductive material comprises a plurality of regions interspersed with lossy material,
the conductive material regions are sized and positioned to align with higher electromagnetic fields close to a subset of the conductive elements designated as signal conductors.

17. The electrical connector of claim 16, wherein:
the lossy material has a thickness between 5 mils and 100 mils.

18. The electrical connector of claim 17, wherein:
the conductive material has a thickness between 1 and 5 mils.

19. The electrical connector of claim 16, wherein:
the conductive material is joined to the lossy material.

20. The electrical connector of claim 19, wherein:
the conductive material is joined to the lossy material through the use of an adhesive.

21. The electrical connector of claim 16, further comprising
a structure pressing the conductive material and lossy material together.

22. The electrical connector of claim 16, wherein:
the lossy material has a bulk conductivity between 40-60 siemens/meter.

23. The electrical connector of claim 16, wherein:
the conductive material comprises copper or gold.

24. The electrical connector of claim 16, wherein:
the conductive material comprises metal foil.

25. The electrical connector of claim 16, wherein:
the component is planar.

26. The electrical connector of claim 16, wherein:
the component has a serpentine shape.

27. The electrical connector of claim 16, wherein:
the lossy material comprises a surface;
the conductive material covers a portion of the surface, the portion being less than all of the surface.

28. An electrical connector, comprising:
a housing;
a plurality of conductive elements supported by the housing;
a component supported by the housing, the component comprising:
lossy material; and
conductive material adjacent the lossy material, wherein:
a portion of the plurality of conductive elements are signal conductors; and
the conductive material comprises a plurality of regions separated by lossy material, the conductive material regions positioned adjacent the signal conductors.

29. The electrical connector of claim 28, wherein the lossy material is electrically lossy material.

30. The electrical connector of claim 16, wherein:
the plurality of conductive elements comprise a first set;
the electrical connector comprises a plurality of sets of conductive elements, with the first set being among the plurality of sets;
the component is a first component;
the electrical connector comprises a plurality of like components, with the first component being among the plurality of components, and
each of the plurality components is adjacent a set of the plurality of sets.

31. The electrical connector of claim 30, wherein:
the plurality of components are sized and positioned to provide far end cross talk of less than −50 dB over a range of 1 GHz to 25 GHz.

32. The electrical connector of claim 30, wherein:
for each of the plurality of components, the conductive material comprises a metal sheet.

33. An electrical connector, comprising:
a housing;
a plurality of conductive elements supported by the housing, the plurality of conductive elements comprising a plurality of sets of conductive elements;
a plurality of like components, each component comprising:
lossy material; and
conductive material adjacent the lossy material, wherein:
each of the plurality of like components is adjacent a set of the plurality of sets;
the plurality of components are sized and positioned to provide far end cross talk of less than −50 dB over a range of 1 GHz to 25 GHz; and
adjacent conductive elements within each of the plurality of sets have a center-to-center spacing of 2 mm or less, and the plurality of sets have a center-to-center spacing of 2 mm or less.

34. The electrical connector of claim 33, wherein:
adjacent conductive elements within each of the plurality of sets have a center-to-center spacing of 1.85 mm or less.

35. The electrical connector of claim 34, wherein:
adjacent conductive elements within each of the plurality of sets have a center-to-center spacing of 1.7 mm or less.

36. An electrical connector, comprising:
a housing;
a plurality of conductive elements supported by the housing, the plurality of conductive elements comprising a plurality of sets of conductive elements;
a plurality of like components, wherein each of the plurality of like components is adjacent a set of the plurality of sets, and each component comprises:
lossy material; and
a metal sheet adjacent the lossy material, wherein:

the component is elongated in a first direction; and the metal sheet comprises a plurality of regions elongated in a second direction, the second direction being orthogonal to the first direction.

37. The electrical connector of claim 36, wherein the plurality of regions are linked by a conductive band.

38. The electrical connector of claim 36, wherein the plurality of regions comprises holes therethrough.

39. The electrical connector of claim 36, wherein:

each of the plurality of conductive elements in each of the plurality of sets comprises a mating contact portion; and the plurality of components are positioned adjacent the mating contact portions.

40. A method of manufacturing an electrical connector, the electrical connector comprising a plurality of columns of conductive elements, the method comprising:

forming a hybrid shield comprising a lossy portion and a conductive portion; and inserting the hybrid shield into a slot in a connector housing, the slot being disposed between two adjacent columns of conductive elements, wherein adjacent conductive elements within each of the two adjacent columns of conductive elements have a center-to-center spacing of 2 mm or less, and the two adjacent columns of conductive elements have a center-to-center spacing of 2 mm or less.

* * * * *